US007568985B2

(12) United States Patent
Beach et al.

(10) Patent No.: US 7,568,985 B2
(45) Date of Patent: Aug. 4, 2009

(54) GOLF CLUB HEAD HAVING MOVABLE WEIGHTS

(75) Inventors: Todd P. Beach, San Diego, CA (US); Thomas Olsavsky, Oceanside, CA (US); Benoit Vincent, Encinitas, CA (US); Ian Wright, Calgary (CA); Kraig Willett, Fallbrook, CA (US); Gery Mel Zimmerman, Fallbrook, CA (US); Joseph Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 11/669,904

(22) Filed: Jan. 31, 2007

(65) Prior Publication Data

US 2007/0105653 A1 May 10, 2007

Related U.S. Application Data

(63) Continuation of application No. 11/067,475, filed on Feb. 25, 2005, now Pat. No. 7,186,190, which is a continuation-in-part of application No. 10/785,692, filed on Feb. 23, 2004, now Pat. No. 7,166,040, which is a continuation-in-part of application No. 10/290,817, filed on Nov. 8, 2002, now Pat. No. 6,773,360.

(51) Int. Cl.
*A63B 53/04* (2006.01)
*A63B 53/06* (2006.01)

(52) U.S. Cl. ..... 473/336; 473/346

(58) Field of Classification Search ..... 473/324–350
See application file for complete search history.

(56) References Cited

U.S. PATENT DOCUMENTS

| | | | |
|---|---|---|---|
| 1,133,129 | A | 3/1915 | Govan |
| 1,518,316 | A | 12/1924 | Ellingham |
| 1,526,438 | A | 2/1925 | Scott |
| 1,538,312 | A | 5/1925 | Beat |
| 1,592,463 | A | 7/1926 | Marker |
| 1,658,581 | A | 2/1928 | Tobia |
| 1,704,119 | A | 3/1929 | Buhrke |
| 1,970,409 | A | 8/1934 | Wiedemann |

(Continued)

FOREIGN PATENT DOCUMENTS

| | | |
|---|---|---|
| DE | 9012884 | 9/1990 |

(Continued)

OTHER PUBLICATIONS

Jackson, Jeff. THe Modern Guide to Golf Clubmaking, Ohio: Dynacraft Golf Products, Inc., copyright 1994, p. 237.*

*Primary Examiner*—Alvin A Hunter
(74) *Attorney, Agent, or Firm*—Klarquist Sparkman, LLP

(57) ABSTRACT

One embodiment of a golf club head having movable weights includes a body with a face plate positioned at a forward portion of the golf club head, a sole positioned at a bottom portion of the golf club head, a crown positioned at a top portion of the golf club head and a skirt positioned around a periphery of the golf club head between the sole and the crown. Two or more weight ports are formed in the body and at least two weights are configured to be retained at least partially within the weight ports.

10 Claims, 9 Drawing Sheets

U.S. PATENT DOCUMENTS

D107,007 S 11/1937 Cashmore
2,214,356 A 9/1940 Wettlaufer
2,225,930 A 12/1940 Sexton
2,360,364 A 10/1944 Reach
2,460,435 A 2/1949 Schaffer
3,064,980 A 11/1962 Steiner
3,466,047 A 9/1969 Rodia et al.
3,556,533 A 1/1971 Hollis
3,589,731 A 6/1971 Chancellor
3,606,327 A 9/1971 Gorman
3,610,630 A 10/1971 Glover
3,652,094 A 3/1972 Glover
3,672,419 A 6/1972 Fischer
3,692,306 A 9/1972 Glover
3,743,297 A 7/1973 Dennis
3,897,066 A 7/1975 Belmont
3,976,299 A 8/1976 Lawrence et al.
3,979,122 A 9/1976 Belmont
3,979,123 A 9/1976 Belmont
4,008,896 A 2/1977 Gordos
4,043,563 A 8/1977 Churchward
4,052,075 A 10/1977 Daly
4,076,254 A 2/1978 Nygren
4,085,934 A 4/1978 Churchward
4,121,832 A 10/1978 Ebbing
4,214,754 A 7/1980 Zebelean
4,262,562 A 4/1981 MacNeill
D259,698 S 6/1981 MacNeill
4,340,229 A 7/1982 Stuff, Jr.
4,411,430 A 10/1983 Dian
4,423,874 A 1/1984 Stuff, Jr.
4,438,931 A 3/1984 Motomiya
4,530,505 A 7/1985 Stuff
D284,346 S 6/1986 Masters
4,602,787 A 7/1986 Sugioka et al.
4,607,846 A 8/1986 Perkins
4,730,830 A 3/1988 Tilley
4,736,093 A 4/1988 Braly
4,754,977 A 7/1988 Sahm
4,795,159 A 1/1989 Nagamoto
4,867,458 A 9/1989 Sumikawa et al.
4,869,507 A 9/1989 Sahm
4,895,371 A 1/1990 Bushner
4,962,932 A 10/1990 Anderson
4,994,515 A * 2/1991 Washiyama et al. ..... 524/269
5,050,879 A 9/1991 Sun et al.
5,058,895 A 10/1991 Igarashi
5,244,210 A 9/1993 Au
5,253,869 A 10/1993 Dingle et al.
D343,558 S 1/1994 Latraverse et al.
5,316,305 A 5/1994 McCabe
5,320,005 A 6/1994 Hsiao
5,328,176 A 7/1994 Lo
5,385,348 A 1/1995 Wargo
5,410,798 A 5/1995 Lo
5,421,577 A 6/1995 Kobayashi
5,429,365 A 7/1995 McKeighen
5,439,222 A 8/1995 Kranenberg
5,441,274 A 8/1995 Clay
5,447,309 A 9/1995 Vincent
5,518,243 A 5/1996 Redman
5,533,730 A 7/1996 Ruvang
5,571,053 A 11/1996 Lane
5,624,331 A 4/1997 Lo et al.
5,629,475 A 5/1997 Chastonay
5,632,694 A 5/1997 Lee
5,669,827 A 9/1997 Nagamoto
5,683,309 A 11/1997 Reimers
5,709,613 A 1/1998 Sheraw
5,718,641 A 2/1998 Lin
D392,526 S 3/1998 Nicely
5,746,664 A 5/1998 Reynolds, Jr.
5,755,627 A 5/1998 Yamazaki et al.
5,769,737 A 6/1998 Holladay et al.
5,776,011 A 7/1998 Su et al.
RE35,955 E 11/1998 Lu
D409,463 S 5/1999 McMullin
5,908,356 A 6/1999 Nagamoto
5,911,638 A 6/1999 Parente et al.
D412,547 S 8/1999 Fong
5,935,019 A 8/1999 Yamamoto
5,941,782 A 8/1999 Cook
5,947,840 A 9/1999 Ryan
5,967,905 A 10/1999 Nakahara et al.
5,997,415 A 12/1999 Wood
6,015,354 A 1/2000 Ahn et al.
6,019,686 A 2/2000 Gray
6,056,649 A 5/2000 Imai
6,089,994 A 7/2000 Sun
6,149,533 A 11/2000 Finn
6,162,132 A 12/2000 Yoneyama
6,162,133 A 12/2000 Peterson
6,238,303 B1 5/2001 Fite
6,270,422 B1 8/2001 Fisher
6,277,032 B1 8/2001 Smith
6,296,579 B1 10/2001 Robinson
6,299,547 B1 10/2001 Kosmatka
6,334,817 B1 1/2002 Ezawa et al.
6,348,014 B1 2/2002 Chiu
6,379,265 B1 4/2002 Hirakawa et al.
6,383,090 B1 5/2002 O'Doherty et al.
6,390,933 B1 5/2002 Galloway
6,409,612 B1 6/2002 Evans et al.
6,440,009 B1 8/2002 Guibaud et al.
6,514,154 B1 2/2003 Finn
6,524,197 B2 2/2003 Boone
6,527,649 B1 3/2003 Neher et al.
6,530,848 B2 3/2003 Gillig
6,565,448 B2 5/2003 Cameron et al.
6,569,040 B2 5/2003 Bradstock
6,641,487 B1 11/2003 Hamburger
6,669,571 B1 12/2003 Cameron et al.
6,739,983 B2 5/2004 Helmstetter et al.
6,757,572 B1 6/2004 Forest
6,773,360 B2 8/2004 Willett et al.
6,988,960 B2 1/2006 Mahaffey et al.
7,140,974 B2 11/2006 Chao et al.
7,153,220 B2 12/2006 Lo
7,163,468 B2 1/2007 Gibbs et al.
7,169,060 B2 1/2007 Stevens et al.
2001/0049310 A1 12/2001 Cheng et al.
2002/0022535 A1 2/2002 Takeda
2002/0072434 A1 6/2002 Yabu
2002/0137576 A1 9/2002 Dammen
2002/0160854 A1 10/2002 Beach et al.
2003/0130059 A1 7/2003 Billings
2004/0087388 A1 5/2004 Beach et al.
2004/0242343 A1 12/2004 Chao
2006/0058112 A1 3/2006 Haralason et al.

FOREIGN PATENT DOCUMENTS

GB 194823 12/1921
JP 05-317465 5/1992
JP 06-304271 4/1993
JP 06-126004 5/1994
JP 09-028844 2/1997
JP 09-327534 12/1997
JP 2773009 7/1998
JP 10-234902 8/1998
JP 10277187 10/1998
JP 10277187 A * 10/1998
JP 2004 222911 8/2004
JP 2005160947 A * 6/2005

| | | | | |
|---|---|---|---|---|
| JP | 2006095055 | A | * | 4/2006 |
| WO | WO 88/02642 | | | 4/1988 |
| WO | WO 01/66199 | | | 9/2001 |
| WO | WO 03/061773 | | | 7/2003 |

* cited by examiner

GOLF CLUB HEAD HAVING MOVABLE WEIGHTS

CROSS REFERENCE TO RELATED APPLICATIONS

The present application is a continuation of U.S. patent application Ser. No. 11/067,475, filed Feb. 25, 2005, now U.S. Pat. No. 7,186,190, which is a continuation-in-part of U.S. patent application Ser. No. 10/785,692, filed Feb. 23, 2004, now U.S. Pat. No. 7,166,040, which is a continuation-in-part of U.S. patent application Ser. No. 10/290,817, filed Nov. 8, 2002 now U.S. Pat. No. 6,773,360. These applications are incorporated herein by this reference.

FIELD

The present application is directed to a golf club head, particularly a golf club head having movable weights.

BACKGROUND

The center of gravity (CG) of a golf club head is a critical parameter of the club's performance. Upon impact, the position of the CG greatly affects launch angle and flight trajectory of a struck golf ball. Thus, much effort has been made over positioning the center of gravity of golf club heads. To that end, current driver and fairway wood golf club heads are typically formed of lightweight, yet durable material, such as steel or titanium alloys. These materials are typically used to form thin club head walls. Thinner walls are lighter, and thus result in greater discretionary weight, i.e., weight available for redistribution around a golf club head. Greater discretionary weight allows golf club manufacturers more leeway in assigning club mass to achieve desired golf club head mass distributions.

Various approaches have been implemented for positioning discretionary mass about a golf club head. Many club heads have integral sole weight pads cast into the head at predetermined locations to lower the club head's center of gravity. Also, epoxy may be added to the interior of the club head through the club head's hosel opening to obtain a final desired weight of the club head. To achieve significant localized mass, weights formed of high-density materials have been attached to the sole, skirt, and other parts of a club head. With these weights, the method of installation is critical because the club head endures significant loads at impact with a golf ball, which can dislodge the weight. Thus, such weights are usually permanently attached to the club head and are limited in total mass. This, of course, permanently fixes the club head's center of gravity.

Golf swings vary among golfers, but the total weight and center of gravity location for a given club head is typically set for a standard, or ideal, swing type. Thus, even though the weight may be too light or too heavy, or the center of gravity too far forward or too far rearward, the golfer cannot adjust or customize the club weighting to his or her particular swing. Rather, golfers often must test a number of different types and/or brands of golf clubs to find one that is suited for them. This approach may not provide a golf club with an optimum weight and center of gravity and certainly would eliminate the possibility of altering the performance of a single golf club from one configuration to another and then back again.

It should, therefore, be appreciated that there is a need for a system for adjustably weighting a golf club head that allows a golfer to fine-tune the club head to accommodate his or her swing. The present application fulfills this need and others.

SUMMARY

Disclosed below are representative embodiments that are not intended to be limiting in any way. Instead, the present disclosure is directed toward novel and nonobvious features, aspects, and equivalents of the embodiments of the golf club head having movable weights described below. The disclosed features and aspects of the embodiments can be used alone or in various novel and nonobvious combinations and sub-combinations with one another.

Briefly, and in general terms, the present application describes a golf club head having movable weights for providing enhanced golf club head performance characteristics. According to some embodiments, the golf club includes a body with a face plate positioned at a forward portion of the golf club head, a sole positioned at a bottom portion of the golf club head, a crown positioned at a top portion of the golf club head and a skirt positioned around a periphery of the golf club head between the sole and the crown. The body also includes an interior cavity and at least two weight ports formed in the body. The golf club head also includes at least one weight that is configured to be retained at least partially within one of the weights ports.

In some embodiments, a golf club head weight port mass is between about 1 gram (g) and about 12 grams (g). In some embodiments, each golf club head weight has a mass between about 1 g and about 100 g. In some embodiments, the golf club has a total weight mass between about 5 g and about 100 g.

In some embodiments, the golf club head has a total weight port mass to body mass ratio between about 0.01 and about 2. In other embodiments, a ratio of the total weight port mass plus the total weight mass to the body mass is between about 0.044 and about 4.6.

In some embodiments, the mass of the golf club head minus the total weight mass is between about 180 g and about 215 g.

In some embodiments, the golf club head has a golf club head origin positioned on the face plate at a geometric center of the face plate. In some embodiments, the golf club head origin has an x-axis tangential to the face plate and generally parallel to the ground when the head is ideally positioned and a y-axis extending generally perpendicular to the x-axis and generally parallel to the ground when the head is ideally positioned.

In some embodiments, the golf club head center of gravity has a head origin y-axis coordinate greater than about 0 mm and less than about 50 mm where the positive y-axis extends from the head origin inwardly toward the cavity. In some embodiments, the golf club head center of gravity has a head origin x-axis coordinate greater than about −5 mm and less than about 8 mm. In some embodiments, the golf club head center of gravity has a head origin z-axis coordinate greater than 0 mm.

In some embodiments, a moment of inertia about the head center of gravity x-axis is between about 70 $kg \cdot mm^2$ and about 400 $kg \cdot mm^2$ and a moment of inertia about a head origin z-axis is between about 200 $kg \cdot mm^2$ and about 600 $kg \cdot mm^2$.

In some embodiments, the weight ports are oriented such that each weight port radial axis and a golf club head impact axis intersect to form a weight port radial axis angle between about 10 degrees and about 80 degrees.

In some embodiments, a golf club head weight port has a volume between about 0.3 $cm^3$ and about 15 $cm^3$.

In some embodiments, a ratio of the total weight port volume to the head volume is between about 0.001 and about 0.050.

In some embodiments, the weight mass multiplied by a vectorial separation distance that separates the weight center of gravity if located in the first weight port and the weight center of gravity if located in the second weight port is between about 50 g·mm and about 15,000 g·mm.

In some embodiments, the golf club head moment of inertia about the head center of gravity x-axis divided by the golf club head mass without weights is between about 800 $mm^2$ and about 4,000 $mm^2$. In some embodiments, the golf club head moment of inertia about the head center of gravity x-axis multiplied by the weight mass is between about 1.4 $g^2 \cdot mm^2$ and about 40 $g^2 \cdot mm^2$.

In some embodiments, the golf club head moment of inertia about the head center of gravity z-axis divided by the golf club head mass without weights is between about 1,500 $mm^2$ and about 6,000 $mm^2$. In some embodiments, the golf club head moment of inertia about the head center of gravity z-axis multiplied by the weight mass is between about 2.5 $g^2 \cdot mm^2$ and about 72 $g^2 \cdot mm^2$.

In some embodiments, a weight positioned on the golf club head has a head origin x-axis coordinate greater than about −40 mm and less than about −20 mm or greater than about 20 mm and less than about 40 mm. In other embodiments, the weight has a head origin x-axis coordinate less than about −40 mm or greater than about 40 mm. In some embodiments, a weight positioned on the golf club head has a head origin y-axis coordinate between about 0 mm and about 130 mm.

In some embodiments, a vectorial distance between a first weight port and a second weight port is between about 5 mm and about 200 mm. In some embodiments, a vectorial distance between the first weight port and the head origin and the second weight port and the head origin is between about 20 mm and about 200 mm.

In some embodiments, the vectorial distance between a first weight and a second weight positioned around the golf club head is between about 5 mm and about 200 mm. The vectorial distance between the first weight center of gravity and the head origin, and the second weight center of gravity and the head origin, is between about 20 mm and about 200 mm in some embodiments.

In some embodiments of a golf club with at least a first weight and a second weight, the first weight has a mass between about 1 gram and about 100 grams and the second weight has a mass between about 1 gram and about 100 grams. The first weight has a head origin x-axis coordinate greater than about 0 mm and less than about 60 mm and the second weight has a head origin x-axis coordinate greater than about −60 mm and less than about 0 mm in some embodiments. In other embodiments, the first and second weights have head origin y-axis coordinates greater than about 0 mm and less than about 130 mm.

In some embodiments, the mass of a maximum weight minus the mass of a minimum weight multiplied by a vectorial distance between the maximum weight center of gravity and the minimum weight center of gravity is between about 950 g·mm and about 14,250 g·mm. In other embodiments, a separation distance between a weight when installed in a first weight port and the weight when installed in a second weight port multiplied by the weight mass is between about 50 g·mm and about 15,000 g·mm In some embodiments, the golf club head includes a first weight positionable proximate a toe portion of the golf club head, a second weight positionable proximate a heel portion of the golf club head and a third weight positionable proximate a rear portion of the golf club head. A vectorial distance between a center of gravity of the first weight and a center of gravity of the second weight is between about 40 mm and about 100 mm, a vectorial distance between a center of gravity of the first weight and a center of gravity of the third weight, and a center of gravity of the second weight and the center of gravity of the third weight, is between about 30 mm and about 90 mm, a vectorial distance between a center of gravity of the first weight and a golf club head origin on the face plate, and a center of gravity of the second weight and the golf club head origin, is between about 20 mm and about 60 mm and a vectorial distance between a center of gravity of the third weight and a golf club head origin on the face plate is between about 40 mm and about 100 mm in some embodiments.

In some embodiments, the golf club head includes a first weight with a head origin x-axis coordinate greater than about −47 mm and less than about −27 mm and a head origin y-axis coordinate greater than about 10 mm and less than about 30 mm, a second weight with a head origin x-axis coordinate greater than about 22 mm and less than about 44 mm and a head origin y-axis coordinate greater than about 10 mm and less than about 30 mm, and a third weight with a head origin x-axis coordinate greater than about −30 mm and less than about 30 mm and a head origin y-axis coordinate greater than about 63 mm and less than about 83 mm.

In some embodiments, the golf club head has a first weight positionable proximate a front toe portion of the golf club head, a second weight positionable proximate a front heel portion of the golf club head, a third weight positionable proximate a rear toe portion of the golf club head and a fourth weight positionable proximate a rear heel portion of the golf club head. In some embodiments, the vectorial distance between a center of gravity of the first weight and a center of gravity of the second weight is between about 40 mm and about 100 mm, the vectorial distance between a center of gravity of the third weight and a center of gravity of the fourth weight is between about 10 mm and about 80 mm, the vectorial distance between a center of gravity of the first weight and a center of gravity of the third weight, and a center of gravity of the second weight and the center of gravity of the fourth weight, is between about 30 mm and about 90 mm, and the vectorial distance between a center of gravity of the first weight and a center of gravity of the fourth weight, and the vectorial distance between a center of gravity of the second weight and a center of gravity of the third weight is between about 40 mm and about 100 mm is between about 40 mm and about 100 mm. In some embodiments, the vectorial distance between a center of gravity of the first weight and a golf club head origin, and a center of gravity of the second weight and the golf club head origin, is between about 20 mm and about 60 mm. In other embodiments, the vectorial distance between a center of gravity of the third weight and a golf club head origin, and a center of gravity of the fourth weight and the golf club head origin, is between about 40 mm and about 100 mm.

In some embodiments, the golf club head has a first weight with a head origin x-axis coordinate greater than about −47 mm and less than about −27 mm and a head origin y-axis coordinate greater than about 10 mm and less than about 30 mm, a second weight with a head origin x-axis coordinate greater than about 24 mm and less than about 44 mm and a head origin y-axis coordinate greater than about 10 mm and less than about 30 mm, a third weight with a head origin x-axis coordinate greater than about −30 mm and less than about −10 mm and a head origin y-axis coordinate greater than about 63 mm and less than about 83 mm and a fourth weight with a head origin x-axis coordinate greater than about 8 mm and less than about 28 mm and a head origin y-axis coordinate greater than about 63 mm and less than about 83 mm.

In some embodiments, the golf club head can have at least a first movable weight positionable proximate a toe portion of the golf club head, a second movable weight positionable proximate a heel portion of the golf club head, a third movable weight positionable proximate a rear portion of the golf club head and a fourth movable weight positionable proximate the rear portion of the golf club head nearer the heel portion of the golf club head than the third movable weight. The first, second, third and fourth movable weights can be positionable around the skirt portion of the golf club head. The golf club head can include at least first, second, third and fourth weight ports formed in the body. The first movable weight may be configured to be retained at least partially within the first weight port, the second movable weight may be configured to be retained at least partially within the second weight port, the third movable weight may be configured to be retained at least partially within the third weight port and the fourth movable weight may be configured to be retained at least partially within the fourth weight port. A distance between the third and fourth movable weights can be smaller than a distance between the first and second movable weights.

In some embodiments, the golf club head has a weight mass to a sum of the body mass and the weight port mass ratio between about 0.05 and about 1.25.

In some embodiments, the golf club head has a face plate with a height between about 32 mm and about 59 mm, a width between about 86 mm and about 111 mm and an aspect ratio between about 0.35 and about 0.58.

In some embodiments, the golf club head has a face plate with a variable thickness face plate. The variable thickness face plate has a generally circular protrusion extending rearwardly from an interior surface of the face plate into the cavity in some embodiments. The face plate, when viewed in cross section, increases in thickness from an outer portion to an intermediate portion of the interior surface and decreases in thickness from the intermediate portion to an inner portion of the interior surface in some embodiments. In yet other embodiments, the face plate has a maximum thickness greater than about 3 mm and a minimum thickness less than about 3 mm, and a ratio of the minimum thickness to maximum thickness is less than about 0.36.

In some embodiments, the golf club head body has a sole with a thickness less than about 0.9 mm over more than about 50% of a surface area of the sole. In more specific embodiments, the skirt is made at least partially from a titanium alloy. In some embodiments, the sole has a localized zone proximate the face plate that has a thickness between about 1 mm and about 3 mm and extends rearwardly away from the face plate a distance greater than about 5 mm. In some embodiments, the golf club head has a sole areal weight less than about 0.45 g/cm$^2$ over more than about 50% of the sole surface area.

In still other embodiments, the golf club head body has a crown with a thickness less than about 0.9 mm over more than about 50% of a surface area of the crown. In some embodiments, the golf club head has a crown areal weight less than about 0.45 g/cm$^2$ over more than about 50% of the crown surface area.

In some embodiments, the golf club head body has a skirt with a thickness less than about 0.9 mm over more than about 50% of a surface area of the crown. In other embodiments, the skirt has a thickness less than about 0.8 mm over more than about 50% of a surface area of the skirt. In some embodiments, the golf club head has a skirt areal weight less than about 0.41 g/cm$^2$ over more than about 50% of the skirt surface area.

In some embodiments, the volume of the golf club head is between about 110 cm$^3$ and about 600 cm$^3$. In yet other embodiments, the loft of the club head is between about 6 degrees and about 30 degrees, In still other embodiments, the golf club head has a mass less than about 222 g. In some embodiments, the golf club head has a lie angle between about 55 degrees and about 65 degrees. In some embodiments, the golf club head has a coefficient of restitution greater than about 0.8.

In some embodiments, the golf club head body is made from a steel alloy, a titanium alloy or a composite material. In other embodiments, the golf club head is made using casting, forging, cold forming or other manufacturing techniques.

The foregoing and additional features and advantages of the disclosed embodiments will become more apparent from the following detailed description, which proceeds with reference to the following drawings.

DETAILED DESCRIPTION

Disclosed below are representative embodiments that are not intended to be limiting in any way. Instead, the present disclosure is directed toward novel and nonobvious features, aspects and equivalents of the embodiments of the golf club information system described below. The disclosed features and aspects of the embodiments can be used alone or in various novel and nonobvious combinations and sub-combinations with one another.

Figure 1:
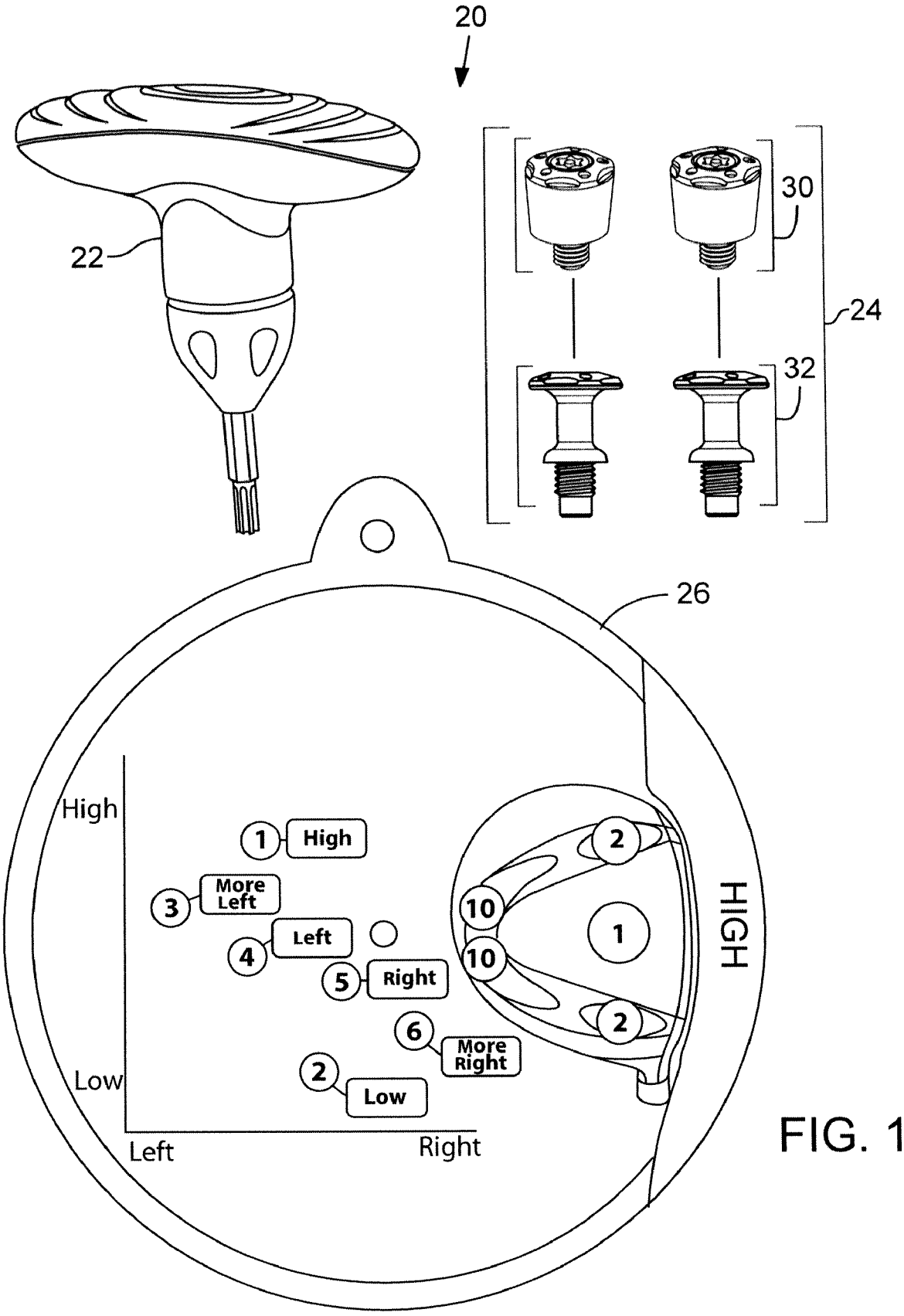
FIG. 1 is a perspective view of an embodiment of a kit for adjustably weighting a golf club head in accordance with the invention.

Now with reference to an illustrative drawing, and particularly FIG. 1, there is shown a kit 20 having a driving tool, i.e., torque wrench 22, and a set of weights 24 usable with a golf club head having conforming recesses, including, for example, weight assemblies 30 and weight screws 23, and an instruction wheel 26. In one particular embodiment, a golf club head 28 includes four recesses, e.g., weight ports 96, 98, 102, 104, disposed about the periphery of the club head (FIGS. 2-5). In the illustrated embodiment of FIGS. 2-5, four weights 24 are provided; two weight assemblies 30 of about ten grams (g) and two weight screws 32 of about two grams (g). Varying placement of the weights within ports 96, 98, 102, and 104 enables the golfer to vary launch conditions of a golf ball struck by the club head 28, for optimum distance and accuracy. More specifically, the golfer can adjust the position of the club head's center of gravity (CG), for greater control over the characteristics of launch conditions and, therefore, the trajectory and shot shape of the struck golf ball.

Figure 15:
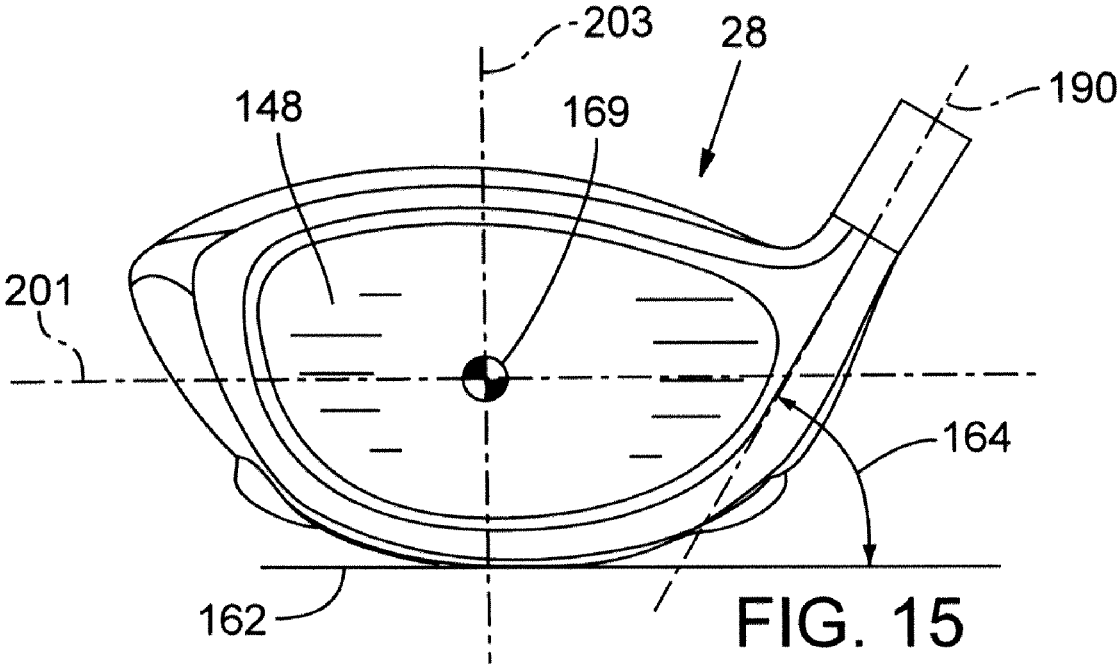
FIG. 15 is a front elevational view of the golf club head of FIG. 2 having four weight ports.

With reference to FIGS. 1-5, weights 24 are sized to be securely received in any of the four ports 96, 98, 102, 104 of club head 28, and are secured in place using the torque wrench 22. The instruction wheel 26 aids the golfer in selecting a proper weight configuration for achieving a desired effect to the trajectory and shape of the golf shot. In some embodiments, the kit 20 provides six different weight configurations for the club head 28, which provides substantial flexibility in positioning CG of the club head 28. Generally, the CG of a golf club head is the average location of the weight of the golf club head or the point at which the entire weight of the golf club head may be considered as concentrated so that if supported at this point the head would remain in equilibrium in any position. In the illustrated embodiment of FIGS. 15 and 16, the CG 169 of club head 28 can be adjustably located in an area adjacent to the sole having a length of about five millimeters measured from front-to-rear and width of about five millimeters measured from toe-to-heel. Each configuration delivers different launch conditions, including ball launch angle, spin-rate and the club head's alignment at impact, as discussed in detail below.

Figure 9:
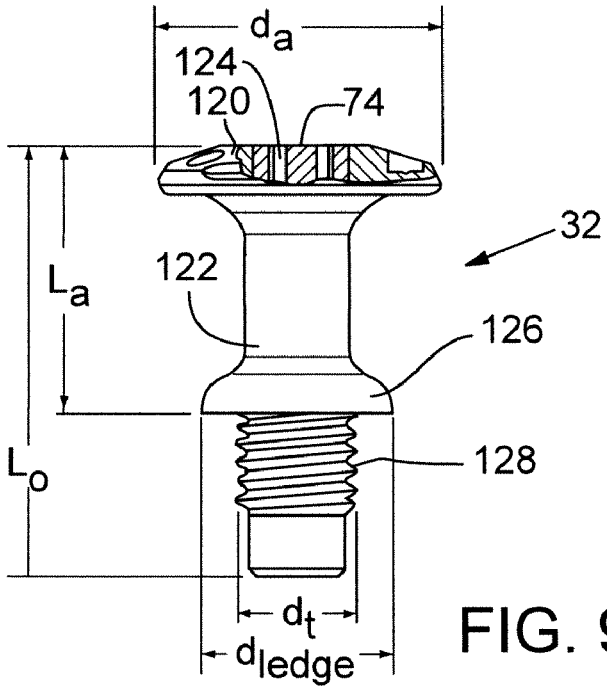
FIG. 9 is a side elevational view of a weight screw of the kit of FIG. 1.

Each of the weight assemblies 30 (FIGS. 10-12) includes a mass element 34, a fastener, e.g., screw 36, and a retaining element 38. In the exemplary embodiment, the weight assemblies 30 are preassembled; however, component parts can be provided for assembly by the user. For weights having a total mass between about one gram and about two grams, weight screws 32 without a mass element preferably are used (FIG. 9). Weight screws 32 can be formed of stainless steel, and the head 120 of each weight screw 32 preferably has a diameter sized to conform to the four ports 96, 98, 102 and 104 of the club head 28.

The kit 20 can be provided with a golf club at purchase, or sold separately. For example, a golf club can be sold with the torque wrench 22, the instruction wheel 26, and the weights 24 (e.g., two 10-gram weights 30 and two 2-gram weights 32) preinstalled. Kits 20 having an even greater variety of weights can also be provided with the club, or sold separately. In another embodiment, a kit 20 having eight weight assemblies is contemplated, e.g., a 2-gram weight, four 6-gram weights, two 14-gram weights, and an 18-gram weight. Such a kit 20 may be particularly effective for golfers with a fairly consistent swing, by providing additional precision in weighting the club head 28. Also, weights in prescribed increments across a broad range can be available. For example, weights 24 in one gram increments ranging from one gram to twenty-five grams can provide very precise weighting, which would be particularly advantageous for advanced and professional golfers. In such embodiments, weight assemblies 30 ranging between five grams and ten grams preferably use a mass element 34 comprising primarily a titanium alloy. Weight assemblies 30, ranging between ten grams to over twenty-five grams, preferably use a mass element 34 comprising a tungsten-based alloy, or blended tungsten alloys. Other materials, or combinations thereof, can be used to achieve a desired weight mass. However, material selection should consider other requirements such as durability, size restraints, and removability.

Instruction Wheel

Figure 6:
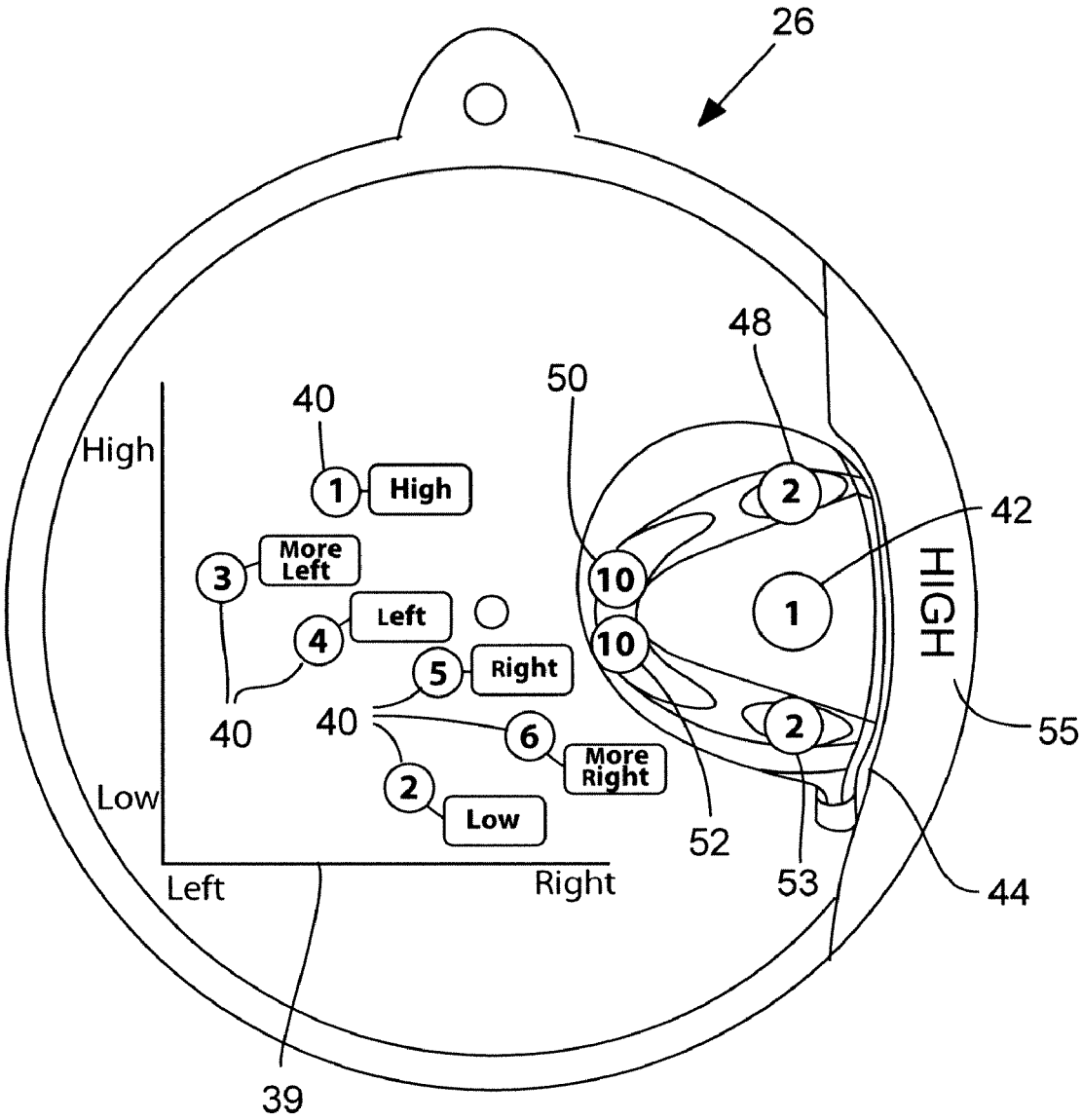
FIG. 6 is a plan view of the instruction wheel of the kit of FIG. 1.

With reference now to FIG. 6, the instruction wheel 26 aids the golfer in selecting a club head weight configuration to achieve a desired effect on the motion path of a golf ball struck by the golf club head 28. The instruction wheel 26 provides a graphic, in the form of a motion path chart 39 on the face of instruction wheel 26 to aid in this selection. The motion path chart's y-axis corresponds to the height control of the ball's trajectory, generally ranging from low to high. The x-axis of the motion path chart corresponds to the directional control of the ball's shot shape, ranging from left to right. In the exemplary embodiment, the motion path chart 39 identifies six different weight configurations 40. Each configuration is plotted as a point on the motion path chart 39. Of course, other embodiments can include a different number of configurations, such as, for kits having a different variety of weights. Also, other approaches for presenting instructions to the golfer can be used, for example, charts, tables, booklets, and so on. The six weight configurations of the exemplary embodiment are listed below in Table 1.

TABLE 1

| Config. | | Weight Distribution | | | |
|---|---|---|---|---|---|
| No. | Description | Fwd Toe | Rear Toe | Fwd Heel | Rear Heel |
| 1 | High | 2 g | 10 g | 2 g | 10 g |
| 2 | Low | 10 g | 2 g | 10 g | 2 g |
| 3 | More Left | 2 g | 2 g | 10 g | 10 g |
| 4 | Left | 2 g | 10 g | 10 g | 2 g |
| 5 | Right | 10 g | 2 g | 2 g | 10 g |
| 6 | More Right | 10 g | 10 g | 2 g | 2 g |

Each weight configuration (i.e., 1 through 6) corresponds to a particular effect on launch conditions and, therefore, a struck golf ball's motion path. In the first configuration, the club head CG is in a center-back location, resulting in a high launch angle and a relatively low spin-rate for optimal distance. In the second configuration, the club head CG is in a center-front location, resulting in a lower launch angle and lower spin-rate for optimal control. In the third configuration, the club head CG is positioned to induce a draw bias. The draw bias is even more pronounced with the fourth configuration. Whereas, in the fifth and sixth configurations, the club head CG is positioned to induce a fade bias, which is more pronounced in the sixth configuration.

Figure 2:
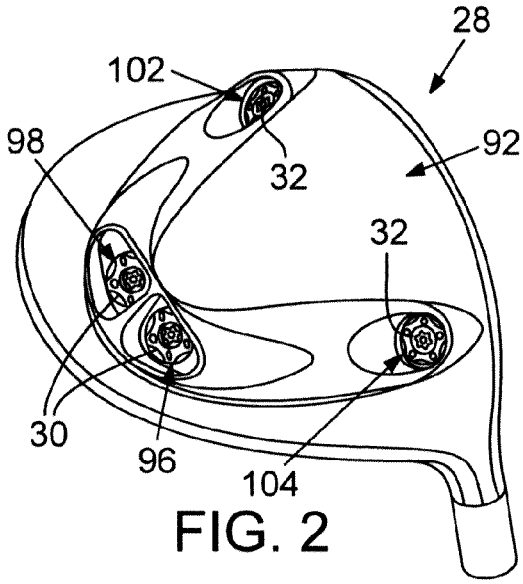
FIG. 2 is a bottom and rear side perspective view of a club head having four weight ports.
Figure 3:
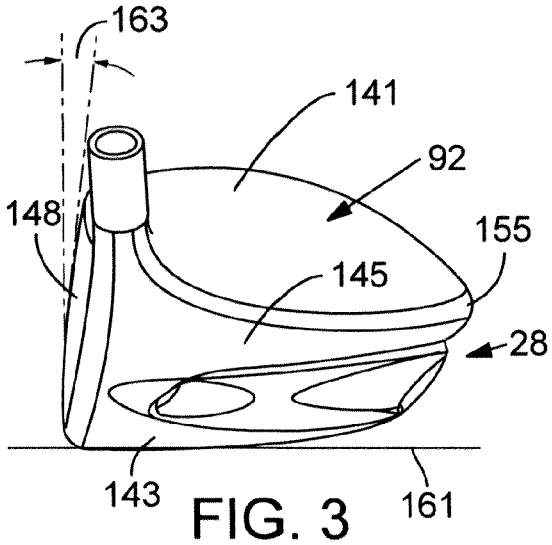
FIG. 3 is a side elevational view of the club head of FIG. 2, depicted from the heel side of the club head.
Figure 4:
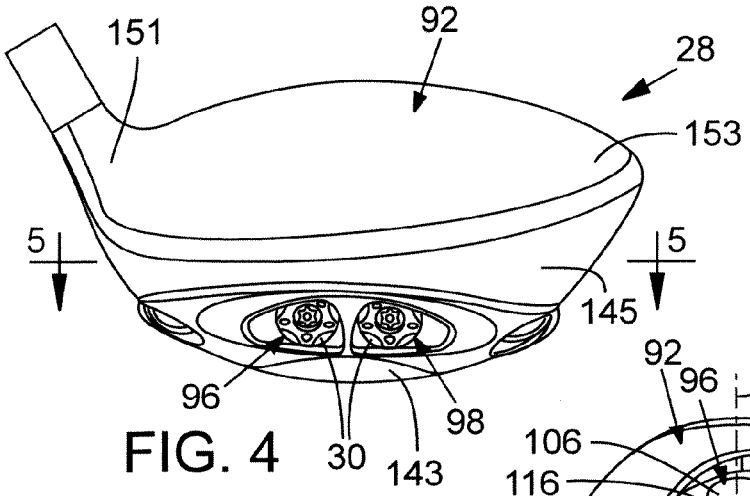
FIG. 4 is a rear elevational view of the club head of FIG. 2.

In use, the golfer selects, from the various motion path chart descriptions, the desired effect on the ball's motion path. For example, if hitting into high wind, the golfer may choose a golf ball motion path with a low trajectory, (e.g., the second configuration). Or, if the golfer has a tendency to hit the ball to the right of the intended target, the golfer may choose a weight configuration that encourages the ball's shot shape to the left (e.g., the third and fourth configurations). Once the configuration is selected, the golfer rotates the instruction wheel 26 until the desired configuration number is visible in the center window 42. The golfer then reads the weight placement for each of the four locations through windows 48, 50, 52, 53, as shown in the graphical representation 44 of the club head 28. The motion path description name is also conveniently shown along the outer edge 55 of the instruction wheel 26. For example, in FIG. 6, the instruction wheel 26 displays weight positioning for the "high" trajectory motion path configuration, i.e., the first configuration. In this configuration, two 10-gram weights are placed in the rear ports 96, 98 and two 2-gram weights are placed in the forward ports 102, 104 (FIG. 2). If another configuration is selected, the instruction wheel 26 depicts the corresponding weight distribution, as provided in Table 1, above.

Torque Wrench

Figure 7:
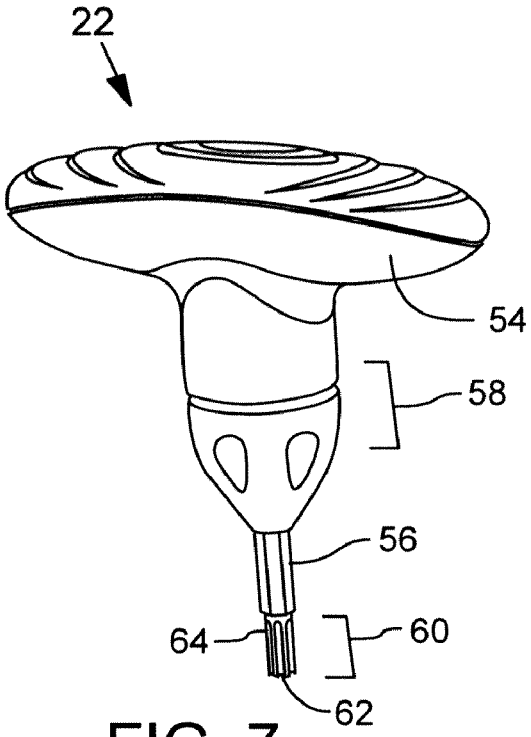
FIG. 7 is a perspective view of the tool of the kit of FIG. 1, depicting a grip and a tip.
Figure 8:
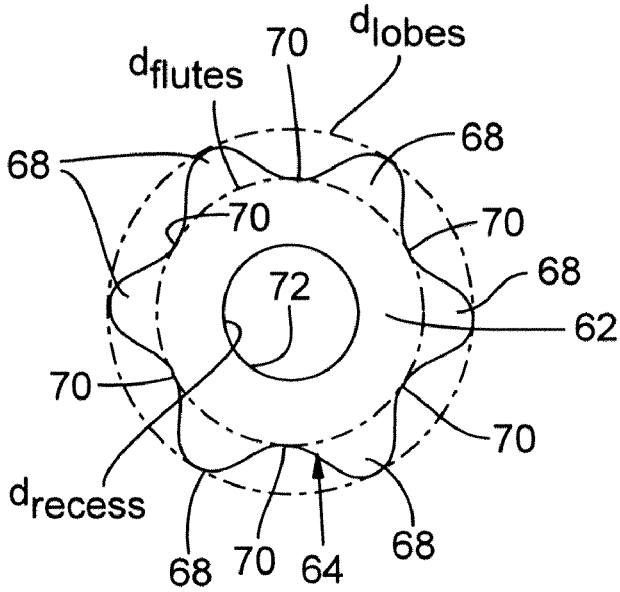
FIG. 8 is a close-up plan view of the tip of the tool of FIG. 7.

With reference now to FIGS. 7-8, the torque wrench 22 includes a grip 54, a shank 56, and a torque-limiting mechanism (not shown). The grip 54 and shank 56 generally form a T-shape; however, other configurations of wrenches can be used. The torque-limiting mechanism is disposed between the grip 54 and the shank 56, in an intermediate region 58, and is configured to prevent over-tightening of the weights 24 into the ports 96, 98, 102, and 104. In use, once the torque limit is met, the torque-limiting mechanism of the exemplary embodiment will cause the grip 54 to rotationally disengage from the shank 56. In this manner, the torque wrench 22 inhibits excessive torque on the weight 24 being tightened. Preferably, the wrench 22 is limited to between about twenty inch-lbs. and forty inch-lbs. of torque. More preferably, the limit is between twenty-seven inch-lbs and thirty-three inch-lbs of torque. In the exemplary embodiment, the wrench 22 is limited to about thirty inch-lbs. of torque. Of course, wrenches having various other types of torque-limiting mechanisms, or even without such mechanisms, can be used. However, if a torque-limiting mechanism is not used, care should be taken not to over-tighten the weights 24.

Figure 10:
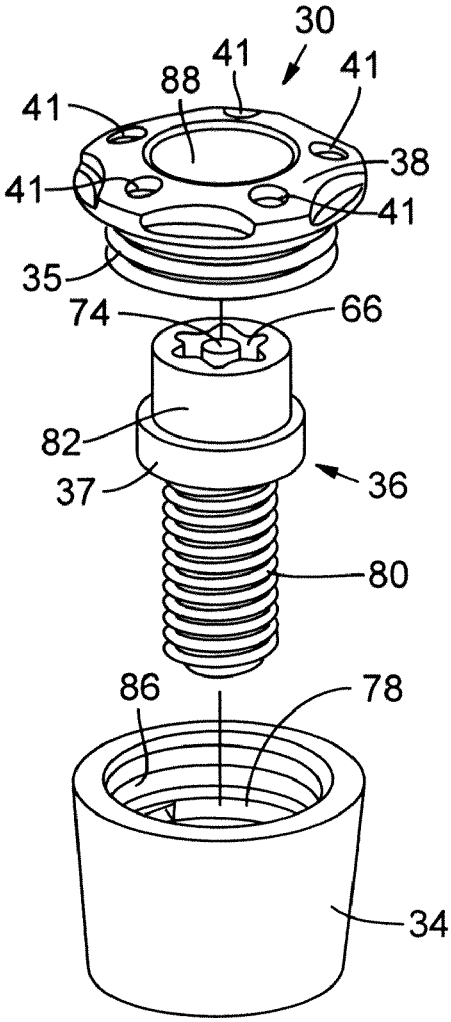
FIG. 10 is an exploded perspective view of a weight assembly of the kit of FIG. 1.
Figure 11:
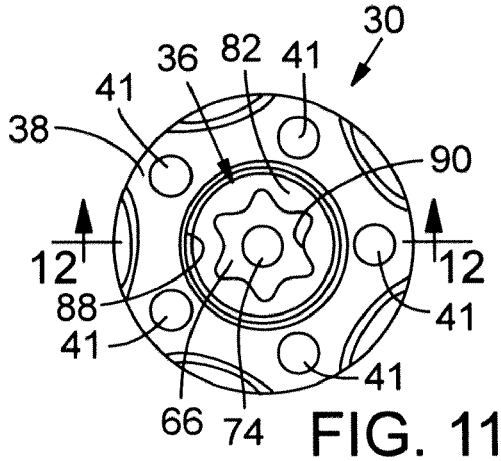
FIG. 11 is a top plan view of the weight assembly of FIG. 10.

The shank 56 terminates in an engagement end, i.e., tip 60, configured to operatively mate with the weight screws 32 and the weight assembly screws 36 (FIGS. 9-11). The tip 60 includes a bottom wall 62 and a circumferential side wall 64. As shown in FIGS. 10 and 11, the head of each of the weight screws 32 and weight assembly screws 36 define a socket 124 and 66, respectively, having a complementary shape to mate with the tip 60. The side wall 64 of the tip 60 defines a plurality of lobes 68 and flutes 70 spaced about the circumference of the tip. The multi-lobular mating of the wrench 22 and the sockets 66 and 124 ensures smooth application of torque and minimizes damage to either device (e.g., stripping of tip 60 or sockets 66, 124). The bottom wall 62 of the tip 66 defines an axial recess 72 configured to receive a post 74 disposed in sockets 66 and 124. The recess 72 is cylindrical and is centered about a longitudinal axis of the shank 56.

With reference now to FIG. 8, the lobes 68 and flutes 70 are spaced equidistant about the tip 60, in an alternating pattern of six lobes and six flutes. Thus, adjacent lobes 68 are spaced about 60 degrees from each other about the circumference of the tip 60. In the exemplary embodiment, the tip 60 has an outer diameter ($d_{lobes}$), defined by the crests of the lobes 68, of about 4.50 mm, and trough diameter ($d_{flutes}$)defined by the troughs of the flutes 70, of about 3.30 mm. The axial recess has a diameter ($d_{recess}$) of about 1.10 mm. Each socket 66, 124 is formed in an alternating pattern of six lobes 90 that complement the six flutes 70 of the wrench tip 60.

Weights

Generally, as shown in FIGS. 1 and 9-12, weights 24, including weight assemblies 30 and weight screws 32, are non-destructively movable about or within golf club head 28. In specific embodiments, the weights 24 can be attached to the club head 28, removed, and reattached to the club head without degrading or destroying the weights or the golf club head. In other embodiments, the weights 24 are accessible from an exterior of the golf club head 28.

With reference now to FIG. 9, each weight screw 32 has a head 120 and a body 122 with a threaded portion 128. The weight screws 32 are preferably formed of titanium or stainless steel, providing a weight with a low mass that can withstand forces endured upon impacting a golf ball with the club head 28. In the exemplary embodiment, the weight screw 32 has an overall length ($L_o$) of about 18.3 mm and a mass of about two grams. In other embodiments, the length and composition of the weight screw 32 can be varied to satisfy particular durability and mass requirements. The weight screw head 120 is sized to enclose one of the corresponding weight ports 96, 98, 102, 104 (FIG. 2) of the club head 28, such that the periphery of the weight screw head 120 generally abuts the side wall of the port. This helps prevent debris from entering the corresponding port. Preferably, the weight screw head 120 has a diameter ranging between about 11 mm and about 13 mm, corresponding to weight port diameters of various exemplary embodiments. In this embodiment, the weight screw head 120 has a diameter of about 12.3 mm. The weight screw head 120 defines a socket 124 having a multi-lobular configuration sized to operatively mate with the wrench tip 60.

The body 122 of the weight screw 32 includes an annular ledge 126 located in an intermediate region thereof. The ledge 126 has a diameter ($d_{ledge}$) greater than that of the threaded openings 110 defined in the ports 96, 98, 102, 104 of the club head 28 (FIG. 2), thereby serving as a stop when the weight screw 32 is tightened. In the embodiment, the annular ledge 126 is a distance ($L_a$) of about 11.5 mm from the weight screw head 120 and has a diameter ($d_a$) of about 6 mm. The weight screw body 122 further includes a threaded portion 128 located below the annular ledge 126. In this embodiment, M5×0.6 threads are used. The threaded portion 128 of the weight screw body 122 has a diameter ($d_t$) of about 5 mm and is configured to mate with the threaded openings 110 defined in the ports 96, 98, 102, 104 of the club head 28.

Figure 12:
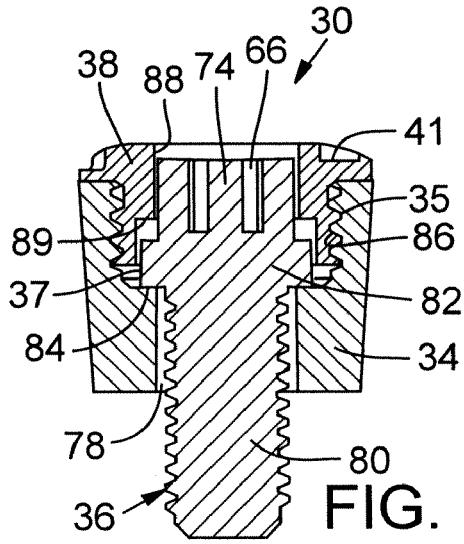
FIG. 12 is a cross-sectional view of the weight assembly of FIG. 10, taken along line 12-12 of FIG. 1.

With reference now to FIGS. 10-12, each mass element 34 of the weight assemblies 30 defines a bore 78 sized to freely receive the weight assembly screw 36. As shown in FIG. 12, the bore 78 includes a lower non-threaded portion and an upper threaded portion. The lower portion is sufficiently sized to freely receive a weight assembly screw body 80, while not allowing the weight assembly screw head 82 to pass. The upper portion of the bore 78 is sufficiently sized to allow the weight assembly screw head 82 to rest therein. More particularly, the weight assembly screw head 82 rests upon a shoulder 84 formed in the bore 78 of the mass element 34. Also, the upper portion of the bore 78 has internal threads 86 for securing the retaining element 38. In constructing the weight assembly 30, the weight assembly screw 36 is inserted into the bore 78 of the mass element 34 such that the lower end of the weight assembly screw body 80 extends out the lower portion of the bore 78 and the weight assembly screw head 82 rests within the upper portion of the bore 78. The retaining element 38 is then threaded into the upper portion of the bore 78, thereby capturing the weight assembly screw 36 in place. A thread locking compound can be used to secure the retaining element 38 to the mass element 34.

The retaining element 38 defines an axial opening 88, exposing the socket 66 of the weight assembly screw head 82 and facilitating engagement of the wrench tip 60 in the socket 66 of the weight assembly screw 36. As mentioned above, the side wall of the socket 66 defines six lobes 90 that conform to the flutes 70 (FIG. 8) of the wrench tip 60. The cylindrical post 74 of the socket 66 is centered about a longitudinal axis of the screw 36. The post 74 is received in the axial recess 72 (FIG. 8) of the wrench 22. The post 74 facilitates proper mating of the wrench 22 and the weight assembly screw 36, as well as inhibiting use of non-compliant tools, such as Phillips screwdrivers, Allen wrenches, and so on.

Club Head

As illustrated in FIGS. 2-5, a golf club head 28 of the present application includes a body 92. The body 92 can include a crown 141, sole 143, skirt 145 and face plate 148 defining an interior cavity 150. The body 92 further includes a heel portion 151, toe portion 153 and rear portion 155.

The crown 141 is defined as an upper portion of the golf club head 28 above a peripheral outline of the head including the top of the face plate 148.

The sole 143 includes a lower portion of the golf club head 28 extending upwards from a lowest point of the club head when the club head is ideally positioned, i.e., at a proper address position. For a typical driver, the sole 143 extends upwards approximately 15 mm above the lowest point when the club head is ideally positioned. For a typical fairway wood, the sole 143 extends upwards approximately 10 mm to about 12 mm above the lowest point when the club head is ideally positioned. A golf club head, such as the club head 28, can be ideally positioned when angle 163 measured between a plane tangent to an ideal impact location on the face plate and a perfectly vertical plane relative to the ground is approximately equal to the golf club head loft and when the golf club head lie angle is approximately equal to an angle between a longitudinal axis of the hosel or shaft and the ground 161. The ideal impact location is disposed at the geometric center of the face plate. The sole 143 can also include a localized zone 189 proximate the face plate 148 having a thickness between about 1 mm and about 3 mm, and extending rearwardly away from the face plate a distance greater than about 5 mm.

The skirt 145 is defined as a side portion of the golf club head between the crown and the sole that extends across a periphery of the golf club head, excluding the face plate, from the toe portion 153, around the rear portion 155, to the heel portion 151.

The crown 141, sole 143 and skirt 145 can be integrally formed using techniques such as molding, cold forming, casting, and/or forging and the face plate 148 can be attached to the crown, sole and skirt by means known in the art. Furthermore, the body 92 can be made from various metals (e.g., titanium alloys, aluminum alloys, steel alloys, magnesium alloys, or combinations thereof), composite material, ceramic material, or combinations thereof.

The face plate 148 is positioned generally at a front portion of the golf club head.

Figure 13:
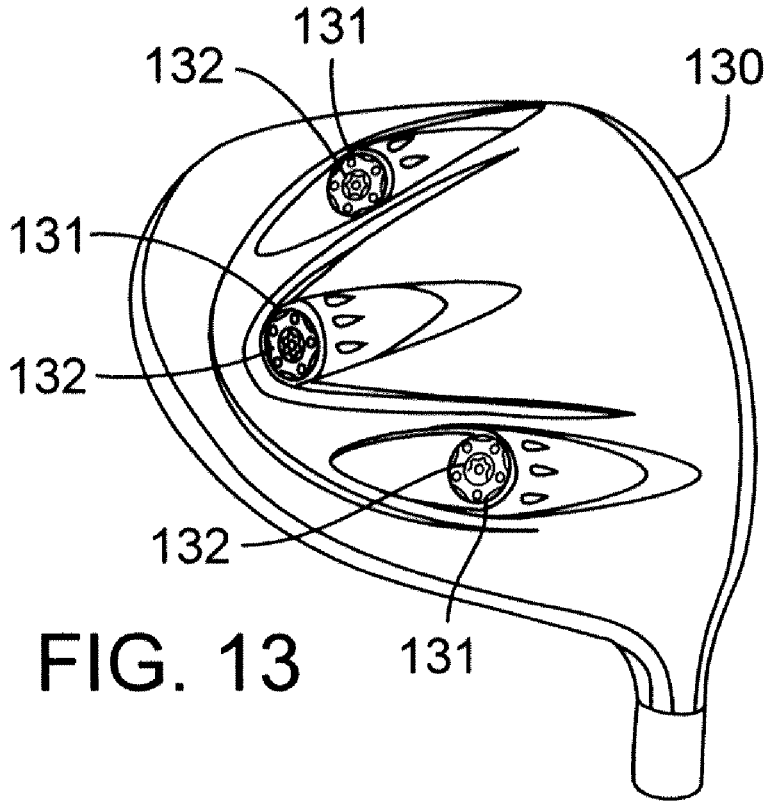
FIG. 13 is a bottom and rear perspective view of a golf club head of the present application having three weights and three weight ports.
Figure 14:
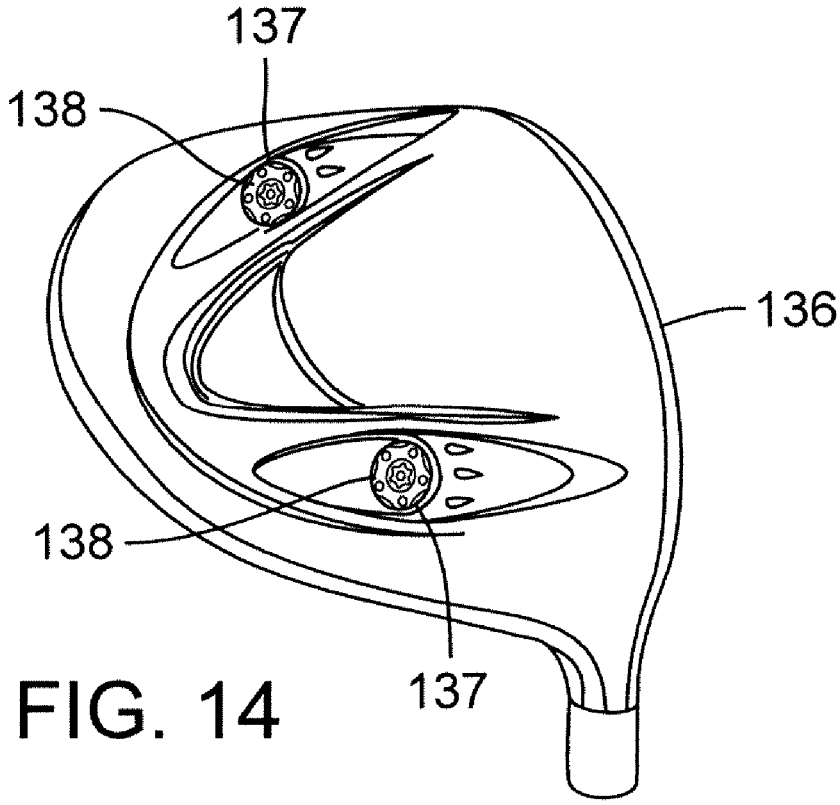
FIG. 14 is a bottom and rear perspective view of a golf club head of the present application having two weights and two weight ports.

The golf club head of the present application can include one or more weight ports. For example, according to some embodiments, and as shown in FIGS. 2-5, the golf club head 28 can include the four weight ports 96, 98, 102 and 104 formed in the club head. In other embodiments, a golf club head can include less or more than four weight ports. For example, in some embodiments, as shown in FIG. 13, golf club head 130 can have three weight ports 131. In still other embodiments, as shown in FIG. 14, golf club head 136 can have two weight ports 137.

Figure 5:
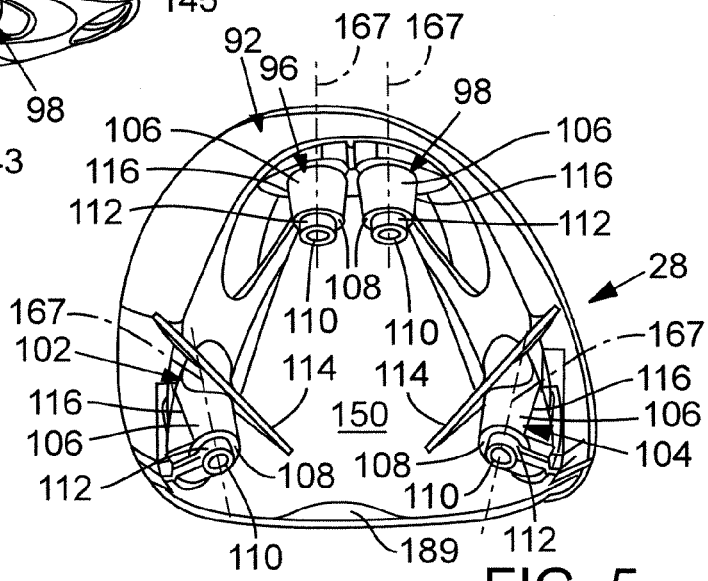
FIG. 5 is a cross sectional view of the club head of FIG. 2, taken along line 5-5 of FIG. 4.

Weight ports can be generally described as a structure coupled to the golf club head crown, golf club head skirt, golf club head sole or any combination thereof that defines a recess, cavity or hole on, about or within the golf club head. Exemplary of weight ports of the present application, weight ports 96, 98, 102, and 104 of FIGS. 2-5 include a weight cavity 116 and a port bottom 108. The ports have a weight port radial axis 167 defined as a longitudinal axis passing through a volumetric centroid, i.e., the center of mass or center of gravity, of the weight port. The port bottom 108 defines a threaded opening 110 for attachment of the weights 24. The threaded opening 110 is configured to receive and secure the threaded body 80 of the weight assembly 30 and threaded body 122 of the weight screw 32. In this embodiment, the threaded bodies 80 and 122 of the weight assembly 30 and weight screw 32, respectively, have M5×0.6 threads. The threaded opening 110 may be further defined by a boss 112 extending either inward or outward relative to the weight cavity 116. Preferably, the boss 112 has a length at least half the length of the body 80 of the screw 36 and, more preferably, the boss has a length 1.5 times a diameter of the body of the screw. As depicted in FIG. 5, the boss 112 extends outward, relative to the weight cavity 116 and includes internal threads (not shown). Alternatively, the threaded opening 110 may be formed without a boss.

As depicted in FIG. 5, the weight ports can include fins or ribs 114 having portions disposed about the ports 96, 98, 102 and 104, and portions formed in the body to provide support within the club head and reduce stresses on the golf club head walls during impact with a golf ball.

In the embodiment shown in FIGS. 2-5, the weights 24 are accessible from the exterior of the club head 28 and securely received into the ports 96, 98, 102, and 104. The weight assemblies 30 preferably stay in place via a press fit while the weights 32 are generally threadably secured. Weights 24 are configured to withstand forces at impact, while also being easy to remove.

In some embodiments, four or more weights may be provided as desired. Yet in other embodiments, a golf club head can have fewer than four weights. For example, as shown in FIG. 13, golf club head 130 can have three weights 132 positioned around the golf club head 130 and, as shown in FIG. 14, golf club head 136 can have two weights 138 positioned around the golf club head 136. In some embodiments, each weight 132 and weight 138 can be a weight assembly or weight screw, such as the weight assembly 30 or weight screw 32.

To attach a weight assembly, such as weight assembly 30, in a port of a golf club head, such as the golf club head 28, the threaded body 30 of the screw 36 is positioned against the threaded opening 110 of the port. With the tip 60 of the wrench 22 inserted through the aperture 88 of the retaining element 38 and engaged in the socket 66 of the screw 36, the user rotates the wrench to screw the weight assembly in place. Pressure from the engagement of the screw 36 provides a press fit of the mass element 34 to the port, as sides of the mass element slide tightly against a wall of the weight cavity 116. The torque limiting mechanism of the wrench prevents overtightening of the weight assembly 30.

Weight assemblies 30 are also configured for easy removal, if desired. To remove, the user mates the wrench 22 with the weight assembly 30 and unscrews it from a club head. As the user turns the wrench 22, the head 82 of the screw 36 applies an outward force on the retaining element 38 and thus helps pull out the mass element 34. Low-friction material can be provided on surfaces of the retaining element 38 and the mass element 34 to facilitate free rotation of the head 82 of the weight assembly screw 36 with respect to the retaining element 38 and the mass element 34.

Similarly, a weight screw, such as weight screws 32, can be attached to the body through a port by positioning the threaded portion of weight 32 against the threaded opening 110 of the port. The tip of the wrench can be used to engage the socket of the weight by rotating the wrench to screw the weight in place.

A. Mass Characteristics

A golf club head of the present application has a head mass defined as the combined masses of the body, weight ports and weights. The body mass typically includes the combined masses of the crown, sole, skirt and face plate, or equivalently, the head mass minus the total weight port mass and the total weight mass. The total weight mass is the combined masses of the weight or weights installed on a golf club head. The total weight port mass is the combined masses of the weight ports and any weight port supporting structures, such as fins 114 shown in FIG. 5.

In several embodiments, one weight port, including any weight port supporting structures, can have a mass between about 1 gram and about 12 grams. A golf club head having two weight ports may have a total weight port mass between about 2 grams and about 24 grams; a golf club head having three weight ports may have a total weight port mass between about 3 grams and about 36 grams; and a golf club head having four weight ports may have a total weight port mass between about 4 grams and about 48 grams.

In several embodiments of the golf club head, the sum of the body mass and the total weight port mass is between about 80 grams and about 222 grams. In more specific embodiments, the sum of the body mass and the total weight port mass is between about 80 grams and about 210 grams. In other embodiments, the sum of the body mass and the total weight port mass is less than about 205 grams or less than about 215 grams.

In some embodiments of the golf club head with two weight ports and two weights, the sum of the body mass and the total weight port mass can be between about 180 grams and about 222 grams. More specifically, in certain embodiments the sum of the body mass and the total weight port mass is between about 180 grams and about 215 grams or between about 198 grams and about 222 grams.

In specific embodiments of the golf club head 28, 130 with three weight ports 132 and three weights 131 or four weight ports 96, 98, 102, 104 and four weights 24, the sum of the body mass and the total weight port mass is between about 191 grams and about 211 grams.

Each weight has a weight mass. In several embodiments, each weight mass can be between about 1 gram and about 100 grams. In specific embodiments, a weight mass can be between about 5 grams and about 100 grams or between about 5 grams and about 50 grams. In other specific embodiments, a weight mass can be between about 1 gram and about 3 grams, between about 1 gram and about 18 grams or between about 6 grams and about 18 grams.

In some embodiments, the total weight mass can be between about 5 grams and about 100 grams. In more specific embodiments, the total weight mass can be between about 5 grams and about 100 grams or between about 50 grams and about 100 grams.

B. Volume Characteristics

The golf club head of the present application has a volume equal to the volumetric displacement of the club head body. In other words, for a golf club head with one or more weight ports within the head, it is assumed that the weight ports are either not present or are "covered" by regular, imaginary surfaces, such that the club head volume is not affected by the presence or absence of ports. In several embodiments, a golf club head of the present application can be configured to have a head volume between about 110 $cm^3$ and about 600 $cm^3$. In more particular embodiments, the head volume is between about 250 $cm^3$ and about 500 $cm^3$. In yet more specific embodiments, the head volume is between about 300 $cm^3$ and about 500 $cm^3$, between 300 $cm^3$ and about 360 $cm^3$, between about 360 $cm^3$ and about 420 $cm^3$ or between about 420 $cm^3$ and about 500 $cm^3$.

In embodiments having a specific golf club head weight and weight port configuration, or thin-walled construction as described in more detail below, the golf club can have approximate head volumes as shown in Table 2 below.

TABLE 2

| One Weight/ Two Weight Ports ($cm^3$) | Two Weights/ Two Weight Ports ($cm^3$) | Three Weights/ Three Weight Ports ($cm^3$) | Four Weights/ Four Weight Ports ($cm^3$) | Thin Sole Construction ($cm^3$) | Thin Skirt Construction ($cm^3$) |
|---|---|---|---|---|---|
| 180-600<br>385-600 | 110-210<br>180-600<br>250-600<br>400-500<br>440-460<br>385-600 | 360-460 | 360-460 | ≦500 | ≧205 |

The weight port volume is measured as the volume of the cavity formed by the port where the port is "covered" by a regular, imaginary surface as described above with respect to club head volume. According to several embodiments, a golf club head of the present invention has a weight port with a weight port volume between about 0.9 $cm^3$ and about 15 $cm^3$.

The total weight port volume is measured as the combined volumes of the weight ports formed in a golf club head. According to some embodiments of a golf club head of the present application, a ratio of the total weight port volume to the head volume is between about 0.001 and about 0.05, between about 0.001 and about 0.007, between about 0.007 and about 0.013, between about 0.013 and about 0.020 or between about 0.020 and about 0.05.

C. Moments of Inertia

Golf club head moments of inertia are typically defined about axes extending through the golf club head CG. As used herein, the golf club head CG location can be provided with reference to its position on a golf club head origin coordinate system.

Figure 16:
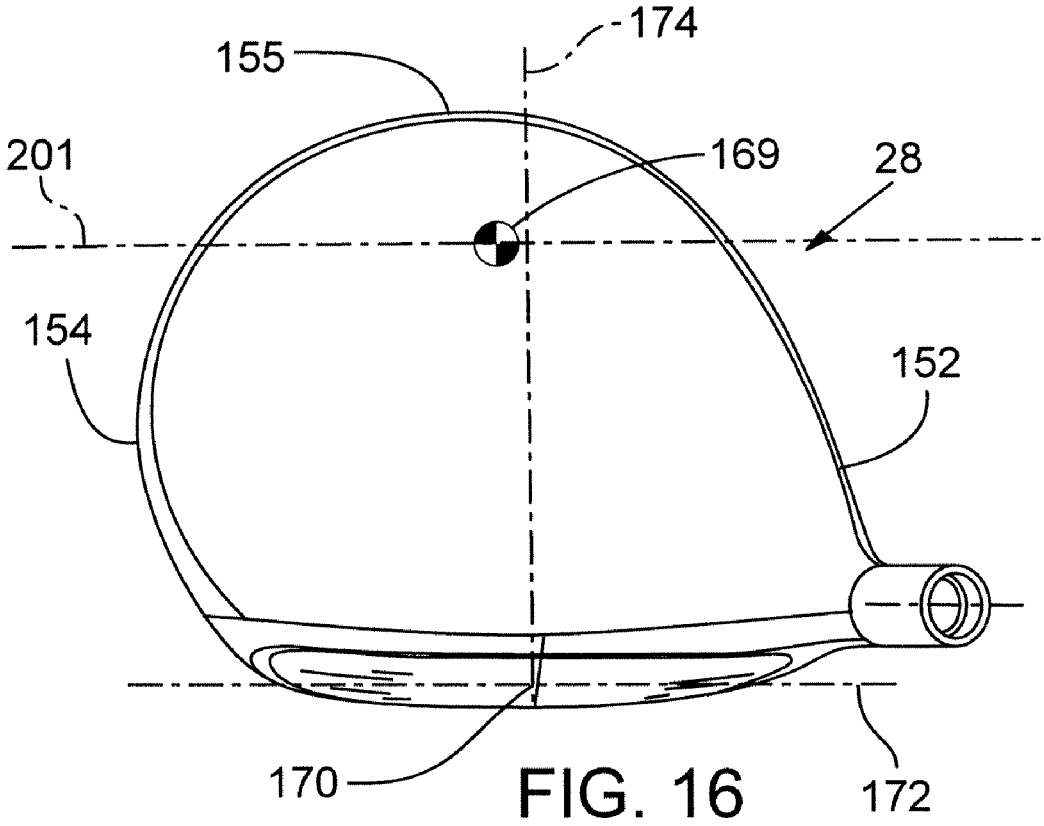
FIG. 16 is a top elevational view of the golf club head of FIG. 15.
Figure 17:
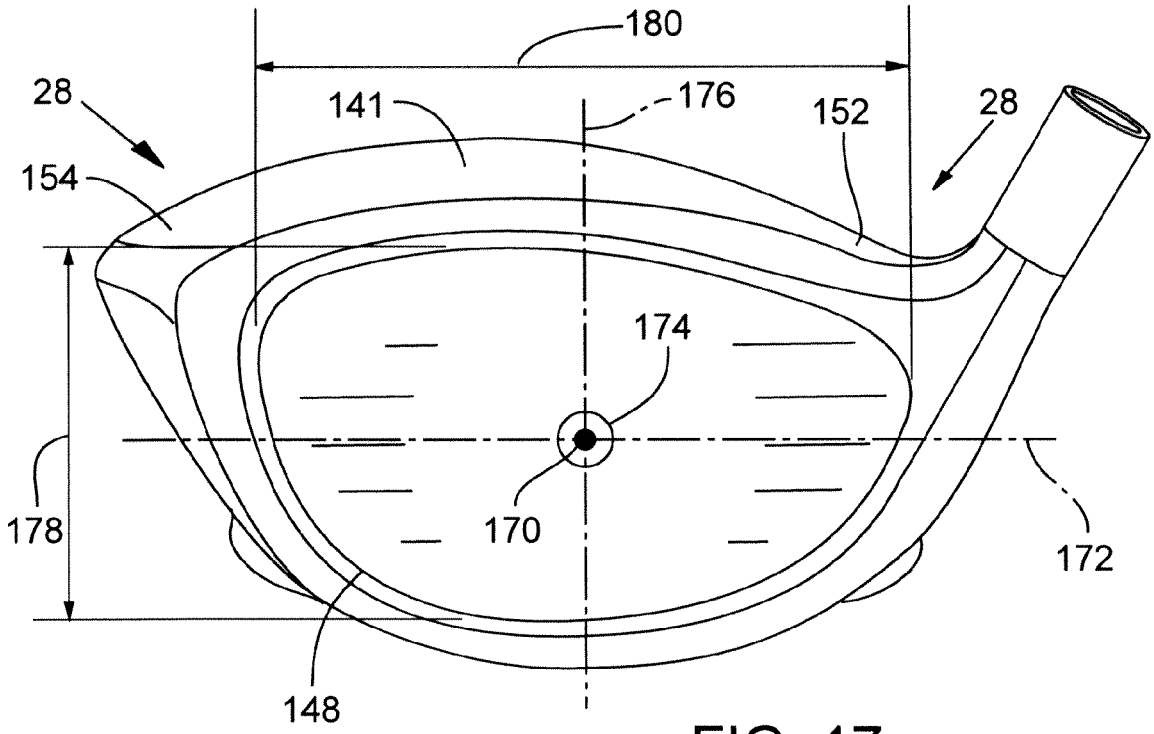
FIG. 17 is a front elevational view of the golf club head of FIG. 15 showing a golf club head origin coordinate system.

According to several embodiments, one of which is illustrated in FIGS. 16 and 17, a golf club head origin 170 is represented on golf club head 28. The golf club head origin 170 is positioned on the face plate 148 at approximately the geometric center, i.e., the intersection of the midpoints of a face plate's height and width. For example, as shown in FIG. 17, the head origin 170 is positioned at the intersection of the midpoints of the face plate height 178 and width 180.

As shown in FIGS. 16 and 17, the head origin coordinate system, with head origin 170, includes an x-axis 172 and a y-axis 174 (extending into the page in FIG. 17). The origin x-axis 172 extends tangential to the face plate and generally parallel to the ground when the head is ideally positioned with the positive x-axis extending from the origin 170 towards a heel 152 of the golf club head 28 and the negative x-axis extending from the origin to the toe of the golf club head. The origin y-axis 174 extends generally perpendicular to the origin x-axis and parallel to the ground when the head is ideally positioned with the positive y-axis extending from the origin 170 towards the rear portion 155 of the golf club. The head origin can also include an origin z-axis 176 extending perpendicular to the origin x-axis and the origin y-axis and having a positive z-axis that extends from the origin 170 towards the top portion of the golf club head 28 and a negative z-axis that extends from the origin towards the bottom portion of the golf club head.

A moment of inertia about a golf club head CG x-axis 201 (see FIGS. 15 and 16), i.e., an axis extending through the golf club head CG 169 and parallel to the head origin x-axis 172, is calculated by the following equation $$I_{CG_x}=\int(y^2+z^2)dm \quad (1)$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis 201 and a golf club head CG z-axis 203 (see FIG. 15), i.e., an axis extending through the golf club head CG 169 and parallel to the head origin z-axis 176 as shown in FIG. 17. The CG xy-plane is a plane defined by the CG x-axis 201 and a golf club head CG y-axis (not shown), i.e., an axis extending through the golf club head CG and parallel to the head origin y-axis.

Similarly, a moment of inertia about the golf club head CG z-axis 203 is calculated by the following equation $$I_{CG_z}=\int(x^2+y^2)dm \quad (2)$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis 203.

As used herein, the calculated values for the moments of inertia about the golf club head CG x-axis 201 and z-axis 203 are based on a golf club head with a body, at least one weight port coupled to the body and at least one installed weight.

1. Moments of Inertia about CG X-Axis

In several embodiments, the golf club head of the present invention can have a moment of inertia about the golf club head CG x-axis 201 between about 70 kg·mm$^2$ and about 400 kg·mm$^2$. More specifically, certain embodiments have a moment of inertia about the head CG x-axis 201 between about 140 kg·mm$^2$ and about 225 kg·mm$^2$, between about 225 kg·mm$^2$ and about 310 kg·mm$^2$ or between about 310 kg·mm$^2$ and about 400 kg·mm$^2$.

In certain embodiments with two weight ports and two weights, the moment of inertia about the head CG x-axis 201 is between about 70 kg·mm$^2$ and about 400 kg·mm$^2$. In specific embodiments with two weight ports and one weight, the moment of inertia about the head CG x-axis 201 is between about 140 kg·mm$^2$ and about 400 kg·mm$^2$. Even more specifically, certain other embodiments have a moment of inertia about the head CG x-axis 201 between about 70 kg·mm$^2$ and about 140 kg·mm$^2$, between about 140 kg·mm$^2$ and about 400 kg·mm$^2$, between about 220 kg·mm$^2$ and about 280 kg·mm$^2$ or between about 220 kg·mm$^2$ and about 360 kg·mm$^2$.

In specific embodiments with three weight ports and three weights or four weight ports and four weights, the moment of inertia about the head CG x-axis 201 is between about 180 kg·mm$^2$ and about 280 kg·mm$^2$.

In some embodiments of a golf club head of the present application having a thin wall sole or skirt, as described below, a moment of inertia about the golf club head CG x-axis 201 can be greater than about 150 kg·mm$^2$. More specifically, the moment of inertia about the head CG x-axis 201 can be between about 150 kg·mm$^2$ and about 180 kg·mm$^2$, between about 180 kg·mm$^2$ and about 200 kg·mm$^2$ or greater than about 200 kg·mm$^2$.

A golf club head of the present invention can be configured to have a first constraint defined as the moment of inertia about the golf club head CG x-axis 201 divided by the sum of the body mass and the total weight port mass. According to some embodiments, the first constraint is between about 800 mm$^2$ and about 4,000 mm$^2$. In specific embodiments, the first constraint is between about 800 mm$^2$ and about 1,100 mm$_2$, between about 1,100 mm$^2$ and about 1,600 mm$^2$ or between about 1,600 mm$^2$ and about 4,000 mm$^2$.

A golf club head of the present application can be configured to have a second constraint defined as the moment of inertia about the golf club head CG x-axis 201 multiplied by the total weight mass. According to some embodiments, the second constraint is between about 1.4 g$^2$·mm$^2$ and about 40 g$^2$·mm$^2$. In certain embodiments, the second constraint is between about 1.4 g$^2$·mm$^2$ and about 2.0 g$^2$·mm$^2$, between about 2.0 g$^2$·mm$^2$ and about 10 g$^2$·mm$^2$ or between about 10 g$^2$·mm$^2$ and about 40 g$^2$·mm$^2$.

2. Moments of Inertia about CG Z-Axis

In several embodiments, the golf club head of the present invention can have a moment of inertia about the golf club head CG z-axis 203 between about 200 kg·mm$^2$ and about 600 kg·mm$^2$. More specifically, certain embodiments have a moment of inertia about the head CG z-axis 203 between about 250 kg·mm$^2$ and about 370 kg·mm$^2$, between about 370 kg·mm$^2$ and about 480 kg·mm$^2$ or between about 480 kg·mm$^2$ and about 600 kg·mm$^2$.

In specific embodiments with two weight ports and one weight, the moment of inertia about the head CG z-axis 203 is between about 250 kg·mm$^2$ and about 600 kg·mm$^2$.

In specific embodiments with two weight ports and two weights, the moment of inertia about the head CG z-axis 203 is between about 200 kg·mm$^2$ and about 600 kg·mm$^2$. Even more specifically, certain embodiments have a moment of inertia about the head CG z-axis 203 between about 200 kg·mm$^2$ and about 350 kg·mm$^2$, between about 250 kg·mm$^2$ and 600 kg·mm$^2$, between about 360 kg·mm$^2$ and about 450 kg·mm$^2$ or between about 360 kg·mm$^2$ and about 500 kg·mm$^2$.

In specific embodiments with three weight ports and three weights or four weight ports and four weights, the moment of inertia about the head CG z-axis 203 is between about 300 kg·mm$^2$ and about 450 kg·mm$^2$.

In some embodiments with a thin wall sole or skirt, a moment of inertia about a golf club head CG z-axis 203 can be greater than about 250 kg·mm$^2$. More specifically, the moment of inertia about head CG z-axis 203 can be between about 250 kg·mm$^2$ and about 300 kg·mm$^2$, between about 300 kg·mm$^2$ and about 350 kg·mm$^2$, between about 350 kg·mm$^2$ and about 400 kg·mm$^2$ or greater than about 400 kg·mm$^2$.

A golf club head can be configured to have a third constraint defined as the moment of inertia about the golf club head CG z-axis 203 divided by the sum of the body mass and the total weight port mass. According to some embodiments, the third constraint is between about 1,500 mm$^2$ and about 6,000 mm$^2$. In certain embodiments, the third constraint is between about 1,500 mm$^2$ and about 2,000 mm$^2$, between about 2,000 mm$^2$ and about 3,000 mm$^2$ or between about 3,000 mm$^2$ and about 6,000 mm$^2$.

A golf club head can be configured to have a fourth constraint defined as the moment of inertia about the golf club head CG z-axis 203 multiplied by the total weight mass. According to some embodiments, the fourth constraint is between about 2.5 $g^2 \cdot mm^2$ and about 72 $g^2 \cdot mm$. In certain embodiments, the fourth constraint is between about 2.5 $g^2 \cdot mm^2$ and about 3.6 $g^2 \cdot mm^2$, between about 3.6 $g^2 \cdot mm^2$ and about 18 $g^2 \cdot mm^2$ or between about 18 $g^2 \cdot mm^2$ and about 72 $g^2 \cdot mm^2$.

D. Positioning of Weight Ports and Weights

In some embodiments of the present application, the location, position or orientation of features of a golf club head, such as golf club head 28, can be referenced in relation to fixed reference points, e.g., a golf club head origin, other feature locations or feature angular orientations. The location or position of a weight, such as weight 24, is typically defined with respect to the location or position of the weight's center of gravity. Similarly, the location or position of a weight port is defined as the location or position of the weight port's volumetric centroid (i.e., the centroid of the cavity formed by a port where the port is "covered" by regular, imaginary surfaces as previously described with respect to club head volume and weight port volume). When a weight or weight port is used as a reference point from which a distance, i.e., a vectorial distance (defined as the length of a straight line extending from a reference or feature point to another reference or feature point) to another weight or weights port is determined, the reference point is typically the center of gravity of the weight or the volumetric centroid of the weight port.

1. Weight Coordinates

The location of a weight on a golf club head can be approximated by its coordinates on the head origin coordinate system as described above in connection with FIGS. 16 and 17. For example, in some embodiments, weights 24 can have origin x-axis 172 coordinates and origin y-axis 174 coordinates on the coordinate system associated with golf club head origin 170.

In some embodiments of golf club head 28 having one weight 24, the weight can have an origin x-axis coordinate between about −60 mm and about 60 mm. In specific embodiments, the weight can have an origin x-axis coordinate between about −20 mm and about 20 mm, between about −40 mm and about 20 mm, between about 20 mm and about 40 mm, between about −60 and about −40 mm, or between about 40 mm and about 60 mm.

In some embodiments, a weight, such as weight 24, can have a y-axis coordinate greater than about 0 mm. More specifically, in certain embodiments, the weight 24 has a y-axis coordinate between about 0 mm and about 20 mm, between about 20 mm and about 50 mm or greater than about 50 mm.

In some embodiments including a first weight and a second weight, the first weight can have an origin x-axis coordinate between about −60 mm and about 0 mm and the second weight can have an origin x-axis coordinate between about 0 mm and about 60 mm. In certain embodiments, the first weight has an origin x-axis coordinate between about −52 mm and about −12 mm, between about −50 mm and about −10 mm, between about −42 mm and about −22 mm or between about −40 mm and about −20 mm. In certain embodiments, the second weight has an origin x-axis coordinate between about 10 mm and about 50 mm, between about 7 mm and about 42 mm, between about 12 mm and about 32 mm or between about 20 mm and about 40 mm. In some embodiments, the first and second weights can have respective y-axis coordinates between about 0 mm and about 130 mm. In certain embodiments, the first and second weights have respective y-axis coordinates between about 20 mm and about 40 mm, between about 20 mm and about 50 mm, between about 36 mm and about 76 mm or between about 46 mm and about 66 mm.

In certain embodiments of the golf club head 130 having first, second and third weights 131, the first weight can have an origin x-axis coordinate between about −47 mm and about −27 mm, the second weight can have an origin x-axis coordinate between about 22 mm and about 44 mm and the third weight can have an origin x-axis coordinate between about −30 mm and about 30 mm. In certain embodiments, the first and second weights can each have a y-axis coordinate between about 10 mm and about 30 mm, and the third weight can have a y-axis coordinate between about 63 mm and about 83 mm.

In certain embodiments of the golf club head 28 having first, second, third and fourth weights 24, the first weight can have an origin x-axis coordinate between about −47 mm and about −27 mm, the second weight can have an origin x-axis coordinate between about 24 mm and about 44 mm, the third weight can have an origin x-axis coordinate between about −30 mm and about −10 mm and the fourth weight can have an origin x-axis coordinate between about 8 mm and about 28 mm. In certain embodiments, the first and second weights can each have a y-axis coordinate between about 10 mm and about 30 mm, and the third and fourth weights can each have a y-axis coordinate between about 63 mm and about 83 mm.

2. Distance from Head Origin to Weights

The location of a weight on a golf club head of the present application can be approximated by its distance away from a fixed point on the golf club head. For example, the positions of the weights 24 about the golf club head 28 can be described according to their distances away from the golf club head origin 170.

In some embodiments of the golf club head 136 having a first weight 137 or a first weight and a second weight 137, distances from the head origin 170 to each weight can be between about 20 mm and 200 mm. In certain embodiments, the distances can be between about 20 mm and about 60 mm, between about 60 mm and about 100 mm, between about 100 mm and about 140 mm or between about 140 mm and about 200 mm.

In some embodiments of the golf club head 130 having three weights 131, including a first weight positioned proximate a toe portion of the golf club head, a second weight positioned proximate a heel portion of the golf club head and a third weight positioned proximate a rear portion of the golf club head, the distances between the head origin and the first and second weights, respectively, can be between about 20 mm and about 60 mm and the distance between the head origin and the third weight can be between about 40 mm and about 100 mm. More specifically, in certain embodiments, the distances between the head origin and the first and second weights, respectively, can be between about 30 mm and about 50 mm and the distance between the head origin and the third weight can be between about 60 mm and about 80 mm.

In some embodiments of the golf club head 28 having four weights 24, including a first weight positioned proximate a front toe portion of the golf club head, a second weight positioned proximate a front heel portion of the golf club head, a third weight positioned proximate a rear toe portion of the golf club head and a fourth weight positioned proximate a rear heel portion of the golf club head, the distances between the head origin and the first and second weights can be between about 20 mm and about 60 mm and the distances between the head origin and the third and fourth weights can be between about 40 mm and about 100 mm. More specifically, in certain embodiments, the distances between the head origin and the first and second weights can be between about 30 mm and about 50 mm and the distances between the head origin and the third and fourth weights can be between about 60 mm and about 80 mm.

3. Distance from Head Origin to Weight Ports

The location of a weight port on a golf club head can be approximated by its distance away from a fixed point on the golf club head. For example, the positions of one or more weight ports about the golf club head 28 can be described according to their distances away from the golf club head origin 170.

In some embodiments of the golf club head 136 having first and second weight ports 138, distances from the head origin 170 to each weight port can be between about 20 mm and 200 mm. In certain embodiments, the distances can be between about 20 mm and about 60 mm, between about 60 mm and about 100 mm, between about 100 mm and about 140 mm or between about 140 mm and about 200 mm.

4. Distance between Weights and/or Weight Ports

The location of a weight and/or a weight port about a golf club head of the present application can also be defined relative to its approximate distance away from other weights and/or weight ports.

In some embodiments, a golf club head of the present application has only one weight and a first weight port and a second weight port. In such an embodiment, a distance between a first weight position, defined for a weight when installed in a first weight port, and a second weight position, defined for the weight when installed in a second weight port, is called a "separation distance." In some embodiments, the separation distance is between about 5 mm and about 200 mm. In certain embodiments, the separation distance is between about 50 mm and about 100 mm, between about 100 mm and about 150 mm or between about 150 mm and about 200 mm. In some specific embodiments, the first weight port is positioned proximate a toe portion of the golf club head and the second weight port is positioned proximate a heel portion of the golf club head.

In some embodiments of the golf club head 136 with two weights 137 and first and second weight ports 138, the two weights include a first weight and a second weight. In some embodiments, the distance between the first and second weights 137 is between about 5 mm and about 200 mm. In certain embodiments, the distance between the first and second weights 137 is between about 5 mm and about 50 mm, between about 50 mm and about 100 mm, between about 100 mm and about 150 mm or between about 150 mm and about 200 mm. In some specific embodiments, the first weight is positioned proximate a toe portion of the golf club head and the second weight is positioned proximate a heel portion of the golf club head.

In some embodiments of a golf club head having at least two weight ports, a distance between the first and second weight ports is between about 5 mm and about 200 mm. In more specific embodiments, the distance between the first and second weight ports is between about 5 mm and about 50 mm, between about 50 mm and about 100 mm, between about 100 mm and about 150 mm or between about 150 mm and about 200 mm. In some specific embodiments, the first weight port is positioned proximate a toe portion of the golf club head and the second weight port is positioned proximate a heel portion of the golf club head.

In some embodiments of the golf club head 130 having first, second and third weights 131, a distance between the first and second weights is between about 40 mm and about 100 mm, and a distance between the first and third weights, and the second and third weights, is between about 30 mm and about 90 mm. In certain embodiments, the distance between the first and second weights is between about 60 mm and about 80 mm, and the distance between the first and third weights, and the second and third weights, is between about 50 mm and about 70 mm. In some embodiments, the first weight is positioned proximate a toe portion of the golf club head, the second weight is positioned proximate a heel portion of the golf club head and the third weight is positioned proximate a rear portion of the golf club head.

In some embodiments of the golf club head 28 having first, second, third and fourth weights 24, a distance between the first and second weights, the first and fourth weights, and the second and third weights is between about 40 mm and about 100 mm; a distance between the third and fourth weights is between about 10 mm and about 80 mm; and a distance between the first and third weights and the second and fourth weights is about 30 mm to about 90 mm. In more specific embodiments, a distance between the first and second weights, the first and fourth weights, and the second and third weights is between about 60 mm and about 80 mm; a distance between the first and third weights and the second and fourth weights is between about 50 mm and about 70 mm; and a distance between the third and fourth weights is between about 30 mm and about 50 mm. In some specific embodiments, the first weight is positioned proximate a front toe portion of the golf club head, the second weight is positioned proximate a front heel portion of the golf club head, the third weight is positioned proximate a rear toe portion of the golf club head and the fourth weight is positioned proximate a rear heel portion of the golf club head.

5. Weight Port Axis Angular Orientations

In some embodiments of a golf club head of the present application, an angle formed between the weight port radial axis and a golf club head impact axis is between about 10 degrees and about 80 degrees. The golf club head impact axis can be defined as the origin y-axis 174 in the negative direction. In some specific embodiments, the angle is between about 25 degrees and about 65 degrees. The angled orientation of the weight port radial axis with respect to the golf club head impact axis is desirable to reduce the axial load on the weights and their associated retaining mechanism when the club head impacts a ball.

E. Distance from Head Origin to Head Center of Gravity

The location of the CG of a club head can be defined by its spatial relationship to a fixed point on the golf club head. For example, as discussed above, the location of the golf club head CG can be described according to the spatial relationship between the CG and the golf club head origin.

In some embodiments of a golf club head of having one weight, the golf club head has a CG with a head origin x-axis coordinate between about −10 mm and about 10 mm and a head origin y-axis coordinate greater than about 15 mm or less than about 50 mm. In some embodiments of a golf club head having two weights, the golf club head has a CG with an origin x-axis coordinate between about −10 mm and about 10 mm or between about −4 mm and about 8 mm, and an origin y-axis coordinate greater than about 15 mm or between about 15 mm and about 50 mm. In some embodiments of a golf club head having three or four weights, the golf club head has a CG with an origin x-axis coordinate between about −3 mm and about 6 mm and an origin y-axis coordinate between about 20 mm and about 40 mm. In some embodiments of a golf club head having a thin sole or thin skirt construction, the golf club head has a CG with an origin x-axis coordinate between about −5 mm and about 5 mm, an origin y-axis coordinate greater than about 0 mm and an origin z-axis coordinate less than about 0 mm.

More particularly, in specific embodiments of a golf club head having specific configurations, the golf club head has a CG with coordinates approximated in Table 3 below.

TABLE 3

| CG Coordinates | Two Weights | Three Weights | Four Weights | Thin Sole/Skirt Construction |
|---|---|---|---|---|
| origin x-axis coordinate (mm) | −3 to 8<br>−3 to 2<br>2 to 6<br>−2 to 1<br>2 to 5<br>−4 to 6<br>−4 to 4<br>−2 to 6 | −3 to 6<br>−1 to 4<br>−3 to 3<br>0 to 6 | −3 to 6<br>−1 to 4<br>−3 to 3 | −2 to 2<br>−1 to 1 |
| origin y-axis coordinate (mm) | 15 to 25<br>25 to 35<br>35 to 50<br>30 to 40<br>31 to 37<br>20 to 30 | 20 to 40<br>23 to 40<br>20 to 37<br>20 to 38<br>22 to 38 | 20 to 40<br>23 to 40<br>20 to 37<br>22 to 38 | 12 to 15<br>15 to 18<br>>18 |
| origin z-axis coordinate (mm) | | | | −1 to 0<br>−2 to −1<br><−2 |

F. Head Geometry and Weight Characteristics

1. Loft and Lie

According to some embodiments of the present application, a golf club head has a loft angle between about 6 degrees and about 16 degrees or between about 13 degrees and about 30 degrees. In yet other embodiments, the golf club has a lie angle between about 55 degrees and about 65 degrees.

2. Coefficient of Restitution

Generally, a coefficient of restitution (COR) of a golf club head is the measurement of the amount of energy transferred between a golf club face plate and a ball at impact. In a simplified form, the COR may be expressed as a percentage of the speed of a golf ball immediately after being struck by the club head divided by the speed of the club head upon impact with the golf ball, with the measurement of the golf ball speed and club head speed governed by United States Golf Association guidelines. In some embodiments of the present application, the golf club head has a COR greater than about 0.8.

3. Thin Wall Construction

According to some embodiments of a golf club head of the present application, the golf club head has a thin wall construction. Among other advantages, thin wall construction facilitates the redistribution of material from one part of a club head to another part of the club head. Because the redistributed material has a certain mass, the material may be redistributed to locations in the golf club head to enhance performance parameters related to mass distribution, such as CG location and moment of inertia magnitude. Club head material that is capable of being redistributed without affecting the structural integrity of the club head is commonly called discretionary weight. In some embodiments of the present invention, thin wall construction enables discretionary weight to be removed from one or a combination of the striking plate, crown, skirt, or sole and redistributed in the form of weight ports and corresponding weights.

Thin wall construction can include a thin sole construction, i.e., a sole with a thickness less than about 0.9 mm but greater than about 0.4 mm over at least about 50% of the sole surface area; and/or a thin skirt construction, i.e., a skirt with a thickness less than about 0.8 mm but greater than about 0.4 mm over at least about 50% of the skirt surface area; and/or a thin crown construction, i.e., a crown with a thickness less than about 0.8 mm but greater than about 0.4 mm over at least about 50% of the crown surface area. More specifically, in certain embodiments of a golf club having a thin sole construction and at least one weight and two weight ports, the sole, crown and skirt can have respective thicknesses over at least about 50% of their respective surfaces between about 0.4 mm and about 0.9 mm, between about 0.8 mm and about 0.9 mm, between about 0.7 mm and about 0.8 mm, between about 0.6 mm and about 0.7 mm, or less than about 0.6 mm. According to a specific embodiment of a golf club having a thin skirt construction, the thickness of the skirt over at least about 50% of the skirt surface area can be between about 0.4 mm and about 0.8 mm, between about 0.6 mm and about 0.7 mm or less than about 0.6 mm.

4. Face Plate Geometries

A height and a width can be defined for the face plate of the golf club head. According to some embodiments and as shown in FIG. 17, a face plate 148 has a height 178 measured from a lowermost point of the face plate to an uppermost point of the face plate, and a width 180 measured from a point on the face plate proximate the heel portion 152 to a point on the face plate proximate a toe portion 154, when the golf club is ideally positioned at address.

For example, in some embodiments of a fairway wood-type golf club head of the present application, the golf club head face plate has a height between about 32 mm and about 38 mm and a width between about 86 mm and about 92 mm. More specifically, a particular embodiment of a fairway wood-type golf club head has a face plate height between about 34 mm and about 36 mm and a width between about 88 mm and about 90 mm. In yet a more specific embodiment of a fairway wood-type golf club head, the face plate height is about 35 mm and the width is about 89 mm.

In some embodiments of a driver type golf club head of the present application, the golf club head face plate has a height between about 53 mm and about 59 mm and a width between about 105 mm and about 111 mm. More specifically, a particular embodiment of a driver type golf club head has a face plate height between about 55 mm and about 57 mm and a width between about 107 mm and about 109 mm. In yet a more specific embodiment of a driver type golf club head, the face plate height is about 56 mm and the width is about 108 mm.

Figure 18:
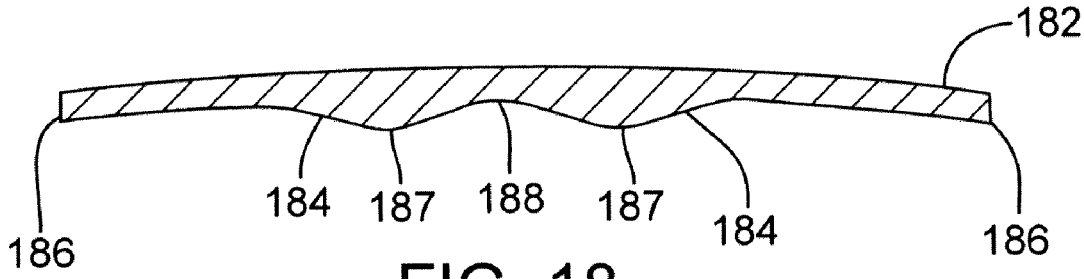
FIG. 18 is a cross-sectional view of a golf club head face plate protrusion.
Figure 19:
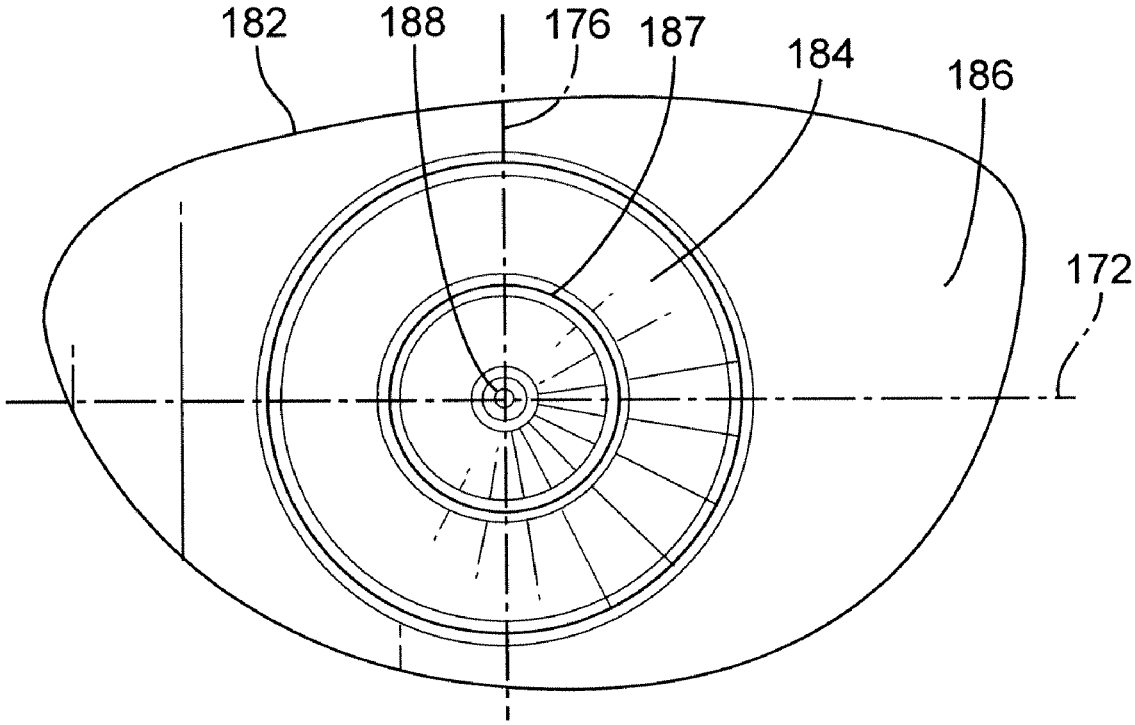
FIG. 19 is a top view of a golf club face plate protrusion.

According to some embodiments, a golf club head face plate can include a variable thickness faceplate. Varying the thickness of a faceplate may increase the size of a club head COR zone, commonly called the sweet spot of the golf club head, which, when striking a golf ball with the golf club head, allows a larger area of the face plate to deliver consistently high golf ball velocity and shot forgiveness. A variable thickness face plate 182, according to one embodiment of a golf club head illustrated in FIGS. 18 and 19, includes a generally circular protrusion 184 extending into the interior cavity towards the rear portion of the golf club head. When viewed in cross-section, as illustrated in FIG. 18, protrusion 184 includes a portion with increasing thickness from an outer portion 186 of the face plate 182 to an intermediate portion 187. The protrusion 184 further includes a portion with decreasing thickness from the intermediate portion 187 to an inner portion 188 positioned approximately at a center of the protrusion preferably proximate the golf club head origin.

In some embodiments of a golf club head having a face plate with a protrusion, the maximum face plate thickness is greater than about 4.8 mm, and the minimum face plate thickness is less than about 2.3 mm. In certain embodiments, the maximum face plate thickness is between about 5 mm and about 5.4 mm and the minimum face plate thickness is between about 1.8 mm and about 2.2 mm. In yet more particular embodiments, the maximum face plate thickness is about 5.2 mm and the minimum face plate thickness is about 2 mm.

In some embodiments of a golf club head having a face plate with a protrusion and a thin sole construction or a thin skirt construction, the maximum face plate thickness is greater than about 3.0 mm and the minimum face plate thickness is less than about 3.0 mm. In certain embodiments, the maximum face plate thickness is between about 3.0 mm and about 4.0 mm, between about 4.0 mm and about 5.0 mm, between about 5.0 mm and about 6.0 mm or greater than about 6.0 mm, and the minimum face plate thickness is between about 2.5 mm and about 3.0 mm, between about 2.0 mm and about 2.5 mm, between about 1.5 mm and about 2.0 mm or less than about 1.5 mm.

For some embodiments of a golf club head of the present application, a ratio of the minimum face plate thickness to the maximum face plate thickness is less than about 0.4. In more specific embodiments, the ratio is between about 0.36 and about 0.39. In yet more certain embodiments, the ratio is about 0.38.

For some embodiments of a fairway wood-type golf club head of the present application, an aspect ratio, i.e., the ratio of the face plate height to the face plate width, is between about 0.35 and about 0.45. In more specific embodiments, the aspect ratio is between about 0.38 and about 0.42, or about 0.4. For some embodiments of a driver type golf club head of the present application, the aspect ratio is between about 0.45 and about 0.58. In more specific embodiments, the aspect ratio is between about 0.49 and about 0.54, or about 0.52.

G. Mass Ratios/Constraints

1. Ratio of Total Weight Port Mass to Body Mass

According to some embodiments of the golf club head 136 having two weight ports 138 and either one weight 137 or two weights 137, a ratio of the total weight port mass to the body mass is between about 0.08 and about 2.0. According to some specific embodiments, the ratio can be between about 0.08 and about 0.1, between about 0.1 and about 0.17, between about 0.17 and about 0.24, between about 0.24 and about 0.3 or between about 0.3 and about 2.0.

In some embodiments of the golf club head 130 having three weight ports 132 and three weights 131, the ratio of the total weight port mass to the body mass is between about 0.015 and about 0.82. In specific embodiments, the ratio is between about 0.015 and about 0.22, between about 0.22 and about 0.42, between about 0.42 and about 0.62 or between about 0.62 and about 0.82.

In some embodiments of the golf club head 28 having four weight ports 96, 98, 102, 104 and four weights 24, the ratio of the total weight port mass to the body mass is between about 0.019 and about 0.3. In specific embodiments, the ratio is between about 0.019 and about 0.09, between about 0.09 and about 0.16, between about 0.16 and about 0.23 or between about 0.23 and about 0.3.

2. Ratio of Total Weight Port Mass Plus Total Weight Mass to Body Mass

According to some embodiments of the golf club head 136 having two weight ports 138 and one weight 137 or two weights 137, a ratio of the total weight port mass plus the total weight mass to the body mass is between about 0.06 and about 3.0. More specifically, according to certain embodiments, the ratio can be between about 0.06 and about 0.3, between about 0.3 and about 0.6, between about 0.6 and about 0.9, between about 0.9 and about 1.2 or between about 1.2 and about 3.0.

In some embodiments of the golf club head 130 having three weight ports 132 and three weights 131, the ratio of the total weight port mass plus the total weight mass to the body mass is between about 0.044 and about 3.1. In specific embodiments, the ratio is between about 0.044 and about 0.8, between about 0.8 and about 1.6, between about 1.6 and about 2.3 or between about 2.3 and about 3.1.

In some embodiments of the golf club head 28 having four weight ports 96, 98, 102, 104 and four weights 24, the ratio of the total weight port mass plus the total weight mass to the body mass is between about 0.049 and about 4.6. In specific embodiments, the ratio is between about 0.049 and about 1.2, between about 1.2 and about 2.3, between about 2.3 and about 3.5 or between about 3.5 and about 4.6.

3. Product of Total Weight Mass and Separation Distance

In some embodiments of the golf club head 136 having two weight ports 138 and one weight 137, the weight mass multiplied by the separation distance of the weight is between about 50 g·mm and about 15,000 g·mm. More specifically, in certain embodiments, the weight mass multiplied by the weight separation distance is between about 50 g·mm and about 500 g·mm, between about 500 g·mm and about 2,000 g·mm, between about 2,000 g·mm and about 5,000 g·mm or between about 5,000 g·mm and about 15,000 g·mm.

4. Product of Maximum Weight Mass Minus Minimum Weight Mass and Distance between Maximum and Minimum Weights In some embodiments of a golf club head of the present application having two, three or four weights, a maximum weight mass minus a minimum weight mass multiplied by the distance between the maximum weight and the minimum weight is between about 950 g·mm and about 14,250 g·mm. More specifically, in certain embodiments, the weight mass multiplied by the weight separation distance is between about 950 g·mm and about 4,235 g·mm, between about 4,235 g·mm and about 7,600 g·mm, between about 7,600 g·mm and about 10,925 g·mm or between about 10,925 g·mm and about 14,250 g·mm.

5. Ratio of Total Weight Mass to Sum of Body Mass and Total Weight Port Mass

According to some embodiments of a golf club head having at least one weight and at least two weight ports, a ratio of the total weight mass to the sum of the body mass plus the total weight port mass is between about 0.05 and about 1.25. In specific embodiments, the ratio is between about 0.05 and about 0.35, between about 0.35 and about 0.65, between about 0.65 and about 0.95 or between about 0.95 and about 1.25.

H. Sole, Crown and Skirt Areal Weights

According to some embodiments of a golf club head of the present application, an areal weight, i.e., material density multiplied by the material thickness, of the golf club head sole, crown and skirt, respectively, is less than about 0.45 $g/cm^2$ over at least about 50% of the surface area of the respective sole, crown and skirt. In some specific embodiments, the areal weight is between about 0.15 $g/cm^2$ and about 0.25 $g/cm^2$, between about 0.25 $g/cm^2$ and about 0.35 $g/cm^2$ or between about 0.35 $g/cm^2$ and about 0.45 $g/cm^2$.

According to some embodiments of a golf club having a skirt thickness less than about 0.8 mm, the head skirt areal weight is less than about 0.41 $g/cm^2$ over at least about 50% of the surface area of the skirt. In specific embodiments, the skirt areal weight is between about 0.15 $g/cm^2$ and about 0.24 $g/cm^2$, between about 0.24 $g/cm^2$ and about 0.33 $g/cm^2$ or between about 0.33 $g/cm^2$ and about 0.41 $g/cm^2$.

I. EXAMPLES

1. Example A

According to one embodiment, a golf club head has two ports and at least one weight. The weight has a head origin x-axis coordinate between about −20 mm and about 20 mm and a mass between about 5 grams and about 50 grams. The golf club head has a volume between about 180 $cm^3$ and about 600 $cm^3$, and a CG with a head origin y-axis coordinate greater than or equal to about 15 mm. In a specific embodiment, the weight has a head origin y-axis coordinate between about 0 mm and about 20 mm, between about 20 mm and about 50 mm, or greater than 50 mm. In a specific embodiment, the golf club head has a CG with a head origin x-axis coordinate between about −10 mm and about 10 mm and a y-axis coordinate less than or equal to about 50 mm. In a more specific embodiment, the golf club head has a moment of inertia about the head CG x-axis between about 140 $kg \cdot mm^2$ and about 400 $kg \cdot mm^2$, and a moment of inertia about the head CG z-axis between about 250 $kg \cdot mm^2$ and about 600 $kg \cdot mm^2$.

2. Example B

According to another embodiment, a golf club head has first and second ports and corresponding first and second weights disposed in the ports. The first weight has a head origin x-axis coordinate between about −60 mm and about 0 mm and a mass between about 1 gram and about 100 grams. The second weight has a head origin x-axis coordinate between about 0 mm and about 60 mm and a mass between about 1 gram and about 100 grams. The golf club head has a volume between about 180 $cm^3$ and about 600 $cm^3$, and a CG with a head origin y-axis coordinate greater than or equal to about 15 mm. In a specific embodiment, the first and second weights each have a head origin y-axis coordinate between about 0 mm and about 130 mm. In a specific embodiment, the golf club head has a CG with a head origin x-axis coordinate between about −10 mm and about 10 mm and a y-axis coordinate between about 15 mm to about 25 mm, or between about 25 mm to about 35 mm, or between about 35 mm to about 50 mm. In a more specific embodiment, the golf club head has a moment of inertia about the head CG x-axis between about 140 $kg \cdot mm^2$ and about 400 $kg \cdot mm^2$, a moment of inertia about the head CG z-axis between about 250 $kg \cdot mm^2$ and about 600 $kg \cdot mm^2$, and a head volume greater than or equal to 250 $cm^3$.

3. Example C

According to another embodiment, a golf club head has two ports and at least one weight. The weight has a head origin x-axis coordinate between about −40 mm and about −20 mm or between about 20 mm and about 40 mm, and a mass between about 5 grams and about 50 grams. The golf club head has a volume between about 180 $cm^3$ and about 600 $cm^3$, and a CG with a head origin y-axis coordinate greater than or equal to about 15 mm. In a specific embodiment, the weight has a head origin y-axis coordinate between about 0 mm and about 20 mm, between about 20 mm and about 50 mm, or greater than 50 mm. In a specific embodiment, the golf club head has a CG with a head origin x-axis coordinate between about −10 mm and about 10 mm and a y-axis coordinate less than or equal to about 50 mm. In a more specific embodiment, the golf club head has a moment of inertia about the head CG x-axis between about 140 $kg \cdot mm^2$ and about 400 $kg \cdot mm^2$, and a moment of inertia about the head CG z-axis between about 250 $kg \cdot mm^2$ and about 600 $kg \cdot mm^2$.

4. Example D

According to another embodiment, a golf club head has two ports and at least one weight. The weight has a head origin x-axis coordinate between about −60 mm and about −40 mm or between about 40 mm and about 60 mm, and a mass between about 5 grams and about 50 grams. The golf club head has a volume between about 180 $cm^3$ and about 600 $cm^3$, and a CG with a head origin y-axis coordinate greater than or equal to about 15 mm. In a specific embodiment, the weight has a y-axis coordinate between about 0 mm and about 20 mm, between about 20 mm and about 50 mm, or greater than 50 mm. In a specific embodiment, the golf club head has a CG with a head origin x-axis coordinate between about −10 mm and about 10 mm and a y-axis coordinate less than or equal to about 50 mm. In a more specific embodiment, the golf club head has a moment of inertia about the head CG x-axis between about 140 $kg \cdot mm^2$ and about 400 $kg \cdot mm^2$, and a moment of inertia about the head CG z-axis between about 250 $kg \cdot mm^2$ and about 600 $kg \cdot mm^2$.

5. Example E

According to another embodiment, a golf club head has first and second ports and corresponding first and second weights disposed in the ports. The first weight has a head origin x-axis coordinate between about −52 mm and about −12 mm, a head origin y-axis coordinate between about 36 mm and about 76 mm, and a mass between about 6 grams and about 18 grams. The second weight has a head origin x-axis coordinate between about 10 mm and about 50 mm, a head origin y-axis coordinate between about 36 mm and about 76 mm, and a mass between about 1 gram and about 3 grams. The golf club head has a CG with a head origin x-axis coordinate between about −3 mm and about 2 mm and a head origin y-axis coordinate between about 30 mm and about 40 mm. In a specific embodiment, the golf club head has a volume between about 400 $cm^3$ and about 500 $cm^3$, and the sum of the body mass and the total port mass is between about 180 grams and about 215 grams. In a more specific embodiment, the golf club head has a moment of inertia about the head CG x-axis between about 220 $kg \cdot mm^2$ and about 360 $kg \cdot mm^2$ and a moment of inertia about the head CG z-axis between about 360 $kg \cdot mm^2$ and about 500 $kg \cdot mm^2$.

6. Example F

According to another embodiment, a golf club head has first and second ports and corresponding first and second weights disposed in the ports. The first weight has a head origin x-axis coordinate between about −52 mm and about −12 mm, a head origin y-axis coordinate between about 36 mm and about 76 mm, and a mass between about 1 gram and about 3 grams. The second weight has a head origin x-axis coordinate between about 10 mm and about 50 mm, a head origin y-axis coordinate between about 36 mm and about 76 mm, and a mass between about 6 gram and about 18 grams. The golf club head has a CG with a head origin x-axis coordinate between about 2 mm and about 6 mm and a head origin y-axis coordinate between about 30 mm and about 40 mm. In a specific embodiment, the golf club head has a volume between about 400 $cm^3$ and about 500 $cm^3$, and the sum of the body mass and the total port mass is between about 180 grams and about 215 grams. In a more specific embodiment, the golf club head has a moment of inertia about the head CG x-axis between about 220 kg·mm$^2$ and about 360 kg·mm$^2$ and a moment of inertia about the head CG z-axis between about 360 kg·mm$^2$ and about 500 kg·mm$^2$.

7. Example G

According to another embodiment, a golf club head has first and second ports and corresponding first and second weights disposed in the ports. The first weight has a head origin x-axis coordinate between about −42 mm and about −22 mm, a head origin y-axis coordinate between about 46 mm and about 66 mm, and a mass between about 6 grams and about 18 grams. The second weight has a head origin x-axis coordinate between about 20 mm and about 40 mm, a head origin y-axis coordinate between about 46 mm and about 66 mm, and a mass between about 1 gram and about 3 grams. The golf club head has a CG with a head origin x-axis coordinate between about −2 mm and about 1 mm and a head origin y-axis coordinate between about 31 mm and about 37 mm. In a specific embodiment, the golf club head has a volume between about 440 cm$^3$ and about 460 cm$^3$, and the sum of the body mass and the total port mass is between about 180 grams and about 215 grams. In a more specific embodiment, the golf club head has a moment of inertia about the head CG x-axis between about 220 kg·mm$^2$ and about 280 kg·mm$^2$ and a moment of inertia about the head CG z-axis between about 360 kg·mm$^2$ and about 450 kg·mm$^2$.

8. Example H

According to another embodiment, a golf club head has first and second ports and corresponding first and second weights disposed in the ports. The first weight has a head origin x-axis coordinate between about −42 mm and about −22 mm, a head origin y-axis coordinate between about 46 mm and about 66 mm, and a mass between about 1 gram and about 3 grams. The second weight has a head origin x-axis coordinate between about 20 mm and about 40 mm, a head origin y-axis coordinate between about 46 mm and about 66 mm, and a mass between about 6 grams and about 18 grams. The golf club head has a CG with a head origin x-axis coordinate between about 2 mm and about 5 mm and a head origin y-axis coordinate between about 31 mm and about 37 mm. In a specific embodiment, the golf club head has a volume between about 440 cm$^3$ and about 460 cm$^3$, and the sum of the body mass and the total port mass is between about 180 grams and about 215 grams. In a more specific embodiment, the golf club head has a moment of inertia about the head CG x-axis between about 220 kg·mm$^2$ and about 280 kg·mm$^2$ and a moment of inertia about the head CG z-axis between about 360 kg·mm$^2$ and about 450 kg·mm$^2$.

9. Example I

According to another embodiment, a golf club head has first and second ports and corresponding first and second weights disposed in the ports. The first weight has a head origin x-axis coordinate between about −50 mm and about −10 mm, a head origin y-axis coordinate between about 20 mm and about 50 mm, and a mass between about 6 grams and about 18 grams. The second weight has a head origin x-axis coordinate between about 7 mm and about 42 mm, a head origin y-axis coordinate between about 20 mm and about 50 mm, and a mass between about 1 gram and about 3 grams. The golf club head has a CG with a head origin x-axis coordinate between about −4 mm and about 4 mm and a head origin y-axis coordinate between about 20 mm and about 30 mm. In a specific embodiment, the golf club head has a volume between about 110 cm$^3$ and about 210 cm$^3$, a loft between about 13 degrees and about 30 degrees, and the sum of the body mass and the total port mass is between about 198 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

10. Example J

According to another embodiment, a golf club head has first and second ports and corresponding first and second weights disposed in the ports. The first weight has a head origin x-axis coordinate between about −50 mm and about −10 mm, a head origin y-axis coordinate between about 20 mm and about 50 mm, and a mass between about 1 gram and about 3 grams. The second weight has a head origin x-axis coordinate between about 7 mm and about 42 mm, a head origin y-axis coordinate between about 20 mm and about 50 mm, and a mass between about 6 grams and about 18 grams. The golf club head has a CG with a head origin x-axis coordinate between about −2 mm and about 6 mm and a head origin y-axis coordinate between about 20 mm and about 30 mm. In a specific embodiment, the golf club head has a volume between about 110 cm$^3$ and about 210 cm$^3$, a loft between about 13 degrees and about 30 degrees, and the sum of the body mass and the total port mass is between about 198 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

11. Example K

According to another embodiment, a golf club head has first and second ports and corresponding first and second weights disposed in the ports. The first weight has a head origin x-axis coordinate between about −40 mm and about −20 mm, a head origin y-axis coordinate between about 20 mm and about 40 mm, and a mass between about 6 grams and about 18 grams. The second weight has a head origin x-axis coordinate between about 12 mm and about 32 mm, a head origin y-axis coordinate between about 20 mm and about 40 mm, and a mass between about 1 gram and about 3 grams. The golf club head has a CG with a head origin x-axis coordinate between about −4 mm and about 4 mm and a head origin y-axis coordinate between about 20 mm and about 30 mm. In a specific embodiment, the golf club head has a volume between about 110 cm$^3$ and about 210 cm$^3$, a loft between about 13 degrees and about 30 degrees, and the sum of the body mass and the total port mass is between about 198 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

12. Example L

According to another embodiment, a golf club head has first and second ports and corresponding first and second weights disposed in the ports. The first weight has a head origin x-axis coordinate between about −40 mm and about −20 mm, a head origin y-axis coordinate between about 20 mm and about 40 mm, and a mass between about 1 gram and about 3 grams. The second weight has a head origin x-axis coordinate between about 12 mm and about 32 mm, a head origin y-axis coordinate between about 20 mm and about 40 mm, and a mass between about 6 grams and about 18 grams. The golf club head has a CG with a head origin x-axis coordinate between about −2 mm and about 6 mm and a head origin y-axis coordinate between about 20 mm and about 30 mm. In a specific embodiment, the golf club head has a volume between about 110 $cm^3$ and about 210 $cm^3$, a loft between about 13 degrees and about 30 degrees, and the sum of the body mass and the total port mass is between about 198 grams and about 222 grams. In a more specific embodiment, the golf club head has a moment of inertia about the head CG x-axis between about 70 $kg \cdot mm^2$ and about 140 $kg \cdot mm^2$ and a moment of inertia about the head CG z-axis between about 200 $kg \cdot mm^2$ and about 350 $kg \cdot mm^2$.

13. Example M

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 6 grams and about 18 grams. The third weight has a head origin x-axis coordinate between about 24 mm and about 44 mm, a head origin y-axis coordinate between about 10 mm and about 30 mm, and a mass between about 1 gram and about 3 grams. The golf club head has a CG with a head origin x-axis coordinate between about −1 mm and about 4 mm and a head origin y-axis coordinate between about 23 mm and about 40 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

14. Example N

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 6 grams and about 18 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 24 mm and about 44 mm, a head origin y-axis coordinate between about 10 mm and about 30 mm, and a mass between about 6 grams and about 18 grams. The golf club head has a CG with a head origin x-axis coordinate between about −1 mm and about 4 mm and a head origin y-axis coordinate between about 20 mm and about 37 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

15. Example O

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 6 grams and about 18 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 24 mm and about 44 mm, a head origin y-axis coordinate between about 10 mm and about 30 mm, and a mass between about 1 gram and about 3 grams. The golf club head has a CG with a head origin x-axis coordinate between about −3 mm and about 3 mm and a head origin y-axis coordinate between about 20 mm and about 38 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

16. Example P

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 6 grams and about 18 grams. The third weight has a head origin x-axis coordinate between about 24 mm and about 44 mm, a head origin y-axis coordinate between about 10 mm and about 30 mm, and a mass between about 6 grams and about 18 grams. The golf club head has a CG with a head origin x-axis coordinate between about 0 mm and about 6 mm and a head origin y-axis coordinate between about 22 mm and about 38 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

17. Example Q

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 24 mm and about 44 mm, a head origin y-axis coordinate between about 10 mm and about 30 mm, and a mass between about 6 grams and about 18 grams. The golf club head has a CG with a head origin x-axis coordinate between about 0 mm and about 6 mm and a head origin y-axis coordinate between about 20 mm and about 38 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

8. Example R

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 6 grams and about 18 grams. The second weight has a head origin x-axis coordinate between about −30 mm and about −10 mm, a head origin y-axis coordinate between about 63 mm and about 83 mm, and a mass between about 6 grams and about 18 grams. The third weight has a head origin x-axis coordinate between about 24 mm and about 44 mm, a head origin y-axis coordinate between about 10 mm and about 30 mm, and a mass between about 1 gram and about 3 grams. The golf club head has a CG with a head origin x-axis coordinate between about −3 mm and about 3 mm and a head origin y-axis coordinate between about 22 mm and about 38 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

19. Example S

According to another embodiment, a golf club head has first, second, third, and fourth ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 6 grams and about 18 grams. The third weight has a head origin x-axis coordinate between about 8 mm and about 28 mm, a head origin y-axis coordinate between about 63 mm and about 83 mm, and a mass between about 6 grams and about 18 grams. The fourth weight has a head origin x-axis coordinate between about 24 mm and about 44 mm, a head origin y-axis coordinate between about 10 mm and about 30 mm, and a mass between about 1 gram and about 3 grams. The golf club head has a CG with a head origin x-axis coordinate between about −1 mm and about 4 mm and a head origin y-axis coordinate between about 23 mm and about 40 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

20. Example T

According to another embodiment, a golf club head has first, second, third, and fourth ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 6 grams and about 18 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 8 mm and about 28 mm, a head origin y-axis coordinate between about 63 mm and about 83 mm, and a mass between about 1 gram and about 3 grams. The fourth weight has a head origin x-axis coordinate between about 24 mm and about 44 mm, a head origin y-axis coordinate between about 10 mm and about 30 mm, and a mass between about 6 grams and about 18 grams. The golf club head has a CG with a head origin x-axis coordinate between about −1 mm and about 4 mm and a head origin y-axis coordinate between about 20 mm and about 37 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

21. Example U

According to another embodiment, a golf club head has first, second, third, and fourth ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 6 grams and about 18 grams. The second weight has a head origin x-axis coordinate between about −30 mm and about −10 mm, a head origin y-axis coordinate between about 63 mm and about 83 mm, and a mass between about 6 grams and about 18 grams. The third weight has a head origin x-axis coordinate between about 8 mm and about 28 mm, a head origin y-axis coordinate between about 63 mm and about 83 mm, and a mass between about 1 gram and about 3 grams. The fourth weight has a head origin x-axis coordinate between about 24 mm and about 44 mm, a head origin y-axis coordinate between about 10 mm and about 30 mm, and a mass between about 1 gram and about 3 grams. The golf club head has a CG with a head origin x-axis coordinate between about −3 mm and about 3 mm and a head origin y-axis coordinate between about 22 mm and about 38 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

22. Example V

According to another embodiment, a golf club head has first, second, third, and fourth ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 8 mm and about 28 mm, a head origin y-axis coordinate between about 63 mm and about 83 mm, and a mass between about 6 grams and about 18 grams. The fourth weight has a head origin x-axis coordinate between about 24 mm and about 44 mm, a head origin y-axis coordinate between about 10 mm and about 30 mm, and a mass between about 6 grams and about 18 grams. The golf club head has a CG with a head origin x-axis coordinate between about 0 mm and about 6 mm and a head origin y-axis coordinate between about 22 mm and about 38 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

23. Preferred Embodiment

According to a preferred embodiment, the sole, skirt, crown, and faceplate of a golf club head are each formed from a titanium alloy. The sole has a thickness less than about 0.9 mm but greater than about 0.4 mm over at least 50% of the sole surface area; the skirt has a thickness less than about 0.8 mm but greater than 0.4 mm over at least 50% of the skirt surface area; and the crown has a thickness less than about 0.8 mm but greater than about 0.4 mm over at least 50% of the crown surface area. The areal weight of the sole, crown, and skirt, respectively, is less than about 0.45 $g/cm^2$ over at least 50% of the surface area of the respective sole, crown and skirt. The golf club head has first, second, third, and fourth ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 1 grams and about 18 grams. The second weight has a head origin x-axis coordinate between about −30 mm and about −10 mm, a head origin y-axis coordinate between about 63 mm and about 83 mm, and a mass between about 1 grams and about 18 grams. The third weight has a head origin x-axis coordinate between about 8 mm and about 28 mm, a head origin y-axis coordinate between about 63 mm and about 83 mm, and a mass between about 1 gram and about 18 grams. The fourth weight has a head origin x-axis coordinate between about 24 mm and about 44 mm, a head origin y-axis coordinate between about 10 mm and about 30 mm, and a mass between about 1 gram and about 18 grams. The golf club head has a CG with a head origin x-axis coordinate between about −3 mm and about 6 mm and a head origin y-axis coordinate between about 20 mm and about 40 mm. The golf club head has a volume between about 360 $cm^3$ and about 460 $cm^3$ and the sum of the body mass and the total port mass is between about 191 grams and about 211 grams. The golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$. The ratio of the golf club head's total weight port volume to the head volume is between about 0.001 and about 0.05, and the angle formed between the weight ports' radial axes and a golf club head impact axis is between about 10 degrees and about 80 degrees. The golf club head has a loft angle between about 6 degrees and about 16 degrees, a lie angle between about 55 degrees and about 65 degrees, and a coefficient of restitution greater than 0.8. The ratio of the golf club head's total weight port mass to the body mass is between about 0.019 and about 0.3, and a maximum weight mass minus a minimum weight mass multiplied by the distance between the maximum weight and the minimum weight is between about 950 g·mm and about 14,250 g·mm. Additionally, a ratio of the golf club head's total weight mass to the sum of the body mass plus the total weight port mass is between about 0.05 and about 1.25.

Various other designs of club heads and weights may be used, such as those disclosed in Applicant's U.S. Pat. No. 6,773,360, which is herein incorporated by reference. Furthermore, other club head designs known in the art can be adapted to take advantage of features of the present invention.

Having illustrated and described the principles of the disclosed embodiments, it will be apparent to those skilled in the art that the embodiments can be modified in arrangement and detail without departing from such principles. In view of the many possible embodiments, it will be recognized that the described embodiments include only examples and should not be taken as a limitation on the scope of the invention. Rather, the invention is defined by the following claims. We therefore claim as the invention all possible embodiments and their equivalents that come within the scope of these claims.

We claim:

1. A wood-type golf club head comprising:

a body comprising a face plate positioned at a forward portion of the golf club head, a sole positioned at a bottom portion of the golf club head, a crown positioned at a top portion of the golf club head and a skirt positioned around a periphery of the golf club head between the sole and the crown, wherein the body defines an interior cavity;

two or more weight ports having an outer portion formed in the body, each weight port having a longitudinal weight port radial axis and being configured to at least partially receive a weight therein; and wherein the weight ports are oriented such that each weight port radial axis and a golf club head origin y-axis form a weight port radial axis angle between about 10 degrees and about 80 degrees; and at least one rib secured to the outer portion of at least one of the weight ports and to the body.

2. The wood-type golf club head according to claim 1, wherein the weight port radial axis angle is between about 25 degrees and about 65 degrees.

3. The wood-type golf club head according to claim 1, wherein the two or more weight ports are configured to receive two weights.

4. The wood-type golf club head according to claim 3, wherein the weight port radial axis angle is between about 25 degrees and about 65 degrees.

5. The wood-type golf club head according to claim 1, wherein the two or more weight ports comprises three weight ports that are configured to receive three weights.

6. The wood-type golf club head according to claim 5, wherein the weight port radial axis angle is between about 25 degrees and about 65 degrees.

7. The wood-type golf club head according to claim 1, wherein the two or more weight ports comprises four weight ports that are configured to receive four weights.

8. The wood-type golf club head according to claim 7, wherein the weight port radial axis angle is between about 25 degrees and about 65 degrees.

9. A wood-type golf club head comprising:

a body comprising a face plate positioned at a forward portion of the golf club head, a sole positioned at a bottom portion of the golf club head, a crown positioned at a top portion of the golf club head and a skirt positioned around a periphery of the golf club head between the sole and the crown, wherein the body defines an interior cavity;

two or more weight ports having an outer portion formed in the body, each weight port having a longitudinal weight port radial axis and being configured to at least partially receive a weight therein; and wherein the weight ports are oriented such that each weight port radial axis and a golf club head origin y-axis form a weight port radial axis angle between about 10 degrees and about 60 degrees; and at least one rib secured to the outer portion of at least one of the weight ports and to the body.

10. The wood-type golf club head according to claim 9, wherein the weight port radial axis angle is between about 25 degrees and about 60 degrees.

* * * * *

UNITED STATES PATENT AND TRADEMARK OFFICE

CERTIFICATE OF CORRECTION

PATENT NO. : 7,568,985 B2
APPLICATION NO. : 11/669904
DATED : August 4, 2009
INVENTOR(S) : Todd P. Beach et al.

It is certified that error appears in the above-identified patent and that said Letters Patent is hereby corrected as shown below:

In the Specification:

Column 6, line 7, "degrees, In" should read --degrees. In--.

Column 17, line 1, "$g^2 \cdot mm$." should read --$g^2 \cdot mm^2$.--.

Column 31, line 25, "8. Example R" should read --18. Example R--.

Signed and Sealed this
Twenty-fifth Day of September, 2012

David J. Kappos

David J. Kappos
*Director of the United States Patent and Trademark Office*